US011753600B2

(12) United States Patent
Sato et al.

(10) Patent No.: US 11,753,600 B2
(45) Date of Patent: Sep. 12, 2023

(54) VISCOSITY INDEX-IMPROVING COMPOSITION AND LUBRICATING OIL COMPOSITION

(71) Applicant: SANYO CHEMICAL INDUSTRIES, LTD., Kyoto (JP)

(72) Inventors: Ryota Sato, Kyoto (JP); Hiroki Yamashita, Kyoto (JP); Kazunori Yoshida, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 17/620,910

(22) PCT Filed: Jun. 15, 2020

(86) PCT No.: PCT/JP2020/023470
§ 371 (c)(1),
(2) Date: Dec. 20, 2021

(87) PCT Pub. No.: WO2020/262088
PCT Pub. Date: Dec. 30, 2020

(65) Prior Publication Data

US 2022/0364013 A1 Nov. 17, 2022

(30) Foreign Application Priority Data

Jun. 26, 2019 (JP) ..... 2019-118197

(51) Int. Cl.

| | |
|---|---|
| ***C10M 169/04*** | (2006.01) |
| ***C10M 145/14*** | (2006.01) |
| ***C10M 149/10*** | (2006.01) |
| ***C10M 157/04*** | (2006.01) |
| *C10N 20/04* | (2006.01) |
| *C10N 30/02* | (2006.01) |

(52) U.S. Cl.
CPC ..... *C10M 169/041* (2013.01); *C10M 145/14* (2013.01); *C10M 149/10* (2013.01); *C10M 157/04* (2013.01); *C10M 2203/003* (2013.01); *C10M 2209/084* (2013.01); *C10M 2217/028* (2013.01); *C10N 2020/04* (2013.01); *C10N 2030/02* (2013.01)

(58) Field of Classification Search
CPC ..... C10M 169/041; C10M 145/14; C10M 149/10; C10M 157/04; C10M 2203/003; C10M 2209/084; C10M 2217/028; C10N 2020/04; C10N 2030/02
See application file for complete search history.

(56) References Cited

U.S. PATENT DOCUMENTS 5,026,496 A * 6/1991 Takigawa ..... C10M 143/00 585/12
5,188,770 A 2/1993 Pennewiss
5,565,130 A 10/1996 Omeis et al.
5,597,871 A 1/1997 Auschra et al.
5,763,374 A * 6/1998 Sakai ..... C10M 145/14 508/469
8,067,349 B2 11/2011 Stoehr et al.
9,683,195 B2 * 6/2017 Nakada ..... C10M 149/10
10,336,961 B2 * 7/2019 Nakada ..... C10M 145/14
11,008,528 B2 * 5/2021 Hagihara ..... C10M 169/041
2002/0123583 A1 9/2002 Gore et al.
2008/0194443 A1 8/2008 Stohr et al.
2010/0190671 A1 7/2010 Stohr et al.
2011/0306533 A1 12/2011 Eisenberg et al.
(Continued)

FOREIGN PATENT DOCUMENTS

CN 1186510 7/1998
EP 0 570 093 11/1993
(Continued)

OTHER PUBLICATIONS

International Search Report dated Sep. 1, 2020 in International (PCT) Application No. PCT/JP2020/023470.
(Continued)

*Primary Examiner* — Ellen M McAvoy
(74) *Attorney, Agent, or Firm* — Wenderoth, Lind & Ponack, L.L.P.

(57) ABSTRACT

The present invention aims to provide a viscosity index improver composition and a lubricating oil composition having a low HTHS viscosity at 100° C., an excellent shear stability, and an excellent low temperature viscosity. The present invention relates to, for example, a viscosity index improver composition (C), containing: a copolymer (A) containing a polyolefin-based monomer (a) represented by the following formula (1) as a constituent monomer; a copolymer (B) containing a (meth)acrylic acid alkyl ester (c) having a C12-C15 straight-chain or branched alkyl group and a (meth)acrylic acid alkyl ester (d) having a C16-C20 straight-chain or branched alkyl group as constituent monomers; and a base oil, wherein a weight average molecular weight ratio {(A)/(B)} of the copolymer (A) to the copolymer (B) is 2 to 55, and a weight ratio (A/B) of the copolymer (A) to the copolymer (B) constituting the viscosity index improver composition (C) is 5 to 100:

[Chem. 1]

(1)

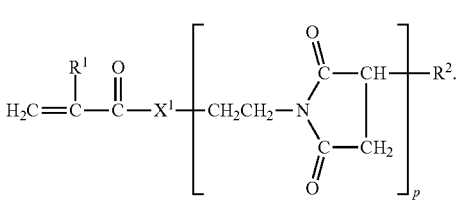

13 Claims, No Drawings

(56) References Cited

U.S. PATENT DOCUMENTS

| | | | | |
|---|---|---|---|---|
| 2016/0097017 | A1 | 4/2016 | Eisenberg et al. | |
| 2017/0009177 | A1* | 1/2017 | Nakada | C10M 145/14 |
| 2018/0245014 | A1* | 8/2018 | Nakada | C08F 220/1818 |
| 2020/0071632 | A1* | 3/2020 | Hagihara | C08F 297/048 |
| 2022/0364013 | A1* | 11/2022 | Sato | C10M 169/041 |

FOREIGN PATENT DOCUMENTS

| | | |
|---|---|---|
| EP | 0 699 694 | 3/1996 |
| EP | 2 186 871 | 5/2010 |
| EP | 3 093 334 | 11/2016 |
| GB | 2 270 317 | 3/1994 |
| JP | 03-143996 | 6/1991 |
| JP | 06-306130 | 11/1994 |
| JP | 7-62372 | 3/1995 |
| JP | 08-169922 | 7/1996 |
| JP | 2732187 | 12/1997 |
| JP | 2754343 | 5/1998 |
| JP | 2941392 | 6/1999 |
| JP | 3474918 | 12/2003 |
| JP | 2004-190034 | 7/2004 |
| JP | 2004-307551 | 11/2004 |
| JP | 2005-200454 | 7/2005 |
| JP | 3831203 | 10/2006 |
| JP | 3999307 | 10/2007 |
| JP | 2008-179792 | 8/2008 |
| JP | 2008-546894 | 12/2008 |
| JP | 2010-532805 | 10/2010 |
| JP | 2013-133460 | 7/2013 |
| JP | 2013-147608 | 8/2013 |
| JP | 2013-203921 | 10/2013 |
| JP | 2014-009293 | 1/2014 |
| JP | 2014/210844 | 11/2014 |
| JP | 2014-224243 | 12/2014 |
| JP | 2014-224246 | 12/2014 |
| JP | 2015-7225 | 1/2015 |
| JP | 2016-169368 | 9/2016 |
| JP | 2017-110196 | 6/2017 |
| WO | 2009/007147 | 1/2009 |
| WO | 2010/051564 | 5/2010 |
| WO | 2010/102903 | 9/2010 |
| WO | 2012/081180 | 6/2012 |
| WO | 2014/170169 | 10/2014 |
| WO | 2015/129732 | 9/2015 |

OTHER PUBLICATIONS

Summons to attend oral proceedings pursuant to Rule 115(1) EPC issued May 6, 2022 in corresponding European Patent Application No. 18772347.3.

Sanyo Chemical News, 2013, No. 476, with English translation.

Sanyo Chemical News, 2015, No. 493, with English translation.

Annex (Communication from the Examining Division) dated Sep. 22, 2020 in European Patent Application No. 15 755 830.5.

English translation of "High-performance viscosity index improvers", Sanyo Chemical Industries Ltd News, 2009, No. 455, pp. 1-11.

Jeti, "Koseino Nendo Shisu Kojozai no Gijutsu Kaihatsu", vol. 57, No. 11, 2009, pp. 188-192; cited in CJ and CK.

Robert F. Fedors, "A Method for Estimating Both the Solubility Parameters and Molar Volumes of Liquids", Polymer Engineering and Science, vol. 14, No. 2, 1974, pp. 147-154.

Marika Joona, "Solubility the Most Important Property—But Difficult to Measure", SP Nynas, cited in Third Party Observation filed Jun. 2, 2016 in JP Application No. 2016-505254.

Charles H. Fisher, "Solubility Parameters of Oil and Fat Chemicals", JAOCS, vol. 78, No. 2, 2001, pp. 215-216.

International Preliminary Report on Patentability dated May 19, 2015 in International (PCT) Patent Application No. PCT/JP2015/055358; with English translation; corresponding to U.S. Appl. No. 15/117,883.

International Search Report dated Jun. 5, 2018 in International (PCT) Application No. PCT/JP2018/011496; corresponding to U.S. Appl. No. 16/493,389.

International Search Report dated May 19, 2015 in International (PCT) Patent Application No. PCT/JP2015/055358; corresponding to U.S. Appl. No. 15/117,883.

* cited by examiner

VISCOSITY INDEX-IMPROVING COMPOSITION AND LUBRICATING OIL COMPOSITION

TECHNICAL FIELD

The present invention relates to a viscosity index improver composition and a lubricating oil composition.

BACKGROUND ART

Nowadays, there is an increasing demand for lower fuel consumption of vehicles in order to reduce the amount of $CO_2$ emission and protect petroleum resources. One approach to reduce the fuel consumption is a reduction in viscous resistance of an engine oil by lowering its viscosity. However, lower viscosity causes problems such as oil leakage and seizure. Meanwhile, in cold regions, startability at low temperatures is required. According to the standard for engine oil viscosity (SAE J300) by SAE International (USA), grade 0W-20 oil is defined as having a high temperature high shear (HTHS) viscosity at 150° C. (ASTM D4683 or D5481) of 2.6 mPa·s or more. The same grade oil is also defined as having a low temperature viscosity at −40° C. of 60,000 mPa·s or less with no yield stress (ASTM D4684) in order to ensure startability in cold regions. To lower the fuel consumption, there is a demand for an engine oil that satisfies the above standard and that has even a lower HTHS viscosity in the effective temperature at 80° C. or 100° C.

Thus, a method that improves viscosity characteristics by adding a viscosity index improver to a lubricating oil has been widely used. Known examples of such a viscosity index improver include methacrylate ester copolymers (Patent Literatures 1 to 4), an olefin copolymer (Patent Literature 5), and a macromonomer copolymer (Patent Literature 6).

However, these viscosity index improvers are insufficient in reducing the HTHS viscosity at 100° C. when added to an engine oil composition. Such an engine oil composition is susceptible to a shear-induced reduction in viscosity and exhibits an increase in viscosity at low temperatures.

CITATION LIST

Patent Literature

Patent Literature 1: JP 2732187 B
Patent Literature 2: JP 2941392 B
Patent Literature 3: JP H07-62372 A
Patent Literature 4: JP 2004-307551 A
Patent Literature 5: JP 2005-200454 A
Patent Literature 6: JP 2008-546894 A

SUMMARY OF INVENTION

Technical Problem

The present invention aims to provide a viscosity index improver composition and a lubricating oil composition having a low HTHS viscosity at 100° C., an excellent shear stability, and an excellent low temperature viscosity.

Solution to Problem

As a result of extensive studies, the present inventors completed the present invention.

Specifically, the present invention relates to a viscosity index improver composition (C), containing: a copolymer (A) containing a polyolefin-based monomer (a) represented by the following formula (1) as a constituent monomer; a copolymer (B) containing a (meth)acrylic acid alkyl ester (c) having a C12-C15 straight-chain or branched alkyl group and a (meth)acrylic acid alkyl ester (d) having a C16-C20 straight-chain or branched alkyl group as constituent monomers; and a base oil, wherein a weight average molecular weight ratio {(A)/(B)} of the copolymer (A) to the copolymer (B) is 2 to 55, and a weight ratio (A/B) of the copolymer (A) to the copolymer (B) constituting the viscosity index improver composition (C) is 5 to 100. The present invention also relates to a lubricating oil composition containing the viscosity index improver composition and at least one additive selected from the group consisting of a detergent, a dispersant, an antioxidant, an oiliness improver, a pour point depressant, a friction and wear modifier, an extreme pressure agent, a defoamer, a demulsifier, a metal deactivator, and a corrosion inhibitor.

[Chem. 1]

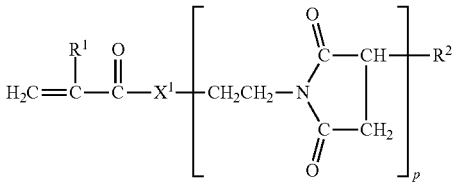

(1)

In the formula, R is a hydrogen atom or a methyl group; —$X^1$— is a group represented by —O—, —$O(AO)_m$—, or —NH—, A is a C2-C4 alkylene group, m is an integer of 1 to 10, and each A may be the same or different when m is 2 or greater; $R^2$ is a residue after removal of one hydrogen atom from a hydrocarbon polymer containing at least one of an isobutylene group or a 1,2-butylene group as a structural unit; and p represents a number of 0 or 1.

Advantageous Effects of Invention

The present invention can provide a viscosity index improver composition and a lubricating oil composition having a low HTHS viscosity at 100° C., an excellent shear stability, and an excellent low temperature viscosity. The viscosity index improver composition and the lubricating oil composition of the present invention achieve effects such as low HTHS viscosity in an effective temperature (100° C.) of engine, less shear-induced reduction in viscosity during use, and suppression of increase in viscosity at low temperatures.

DESCRIPTION OF EMBODIMENTS

The present invention relates to a viscosity index improver composition (C), containing: a copolymer (A) containing a polyolefin-based monomer (a) represented by the following formula (1) as a constituent monomer; a copolymer (B) containing a (meth)acrylic acid alkyl ester (c) having a C12-C15 straight-chain or branched alkyl group and a (meth)acrylic acid alkyl ester (d) having a 016-C20 straight-chain or branched alkyl group as constituent monomers; and a base oil, wherein a weight average molecular weight ratio {(A)/(B)} of the copolymer (A) to the copolymer (B) is 2 to 55, and a weight ratio (A/B) of the copolymer (A) to the copolymer (B) constituting the viscosity index improver composition (C) is 5 to 100.

Instead of using one copolymer containing all of the monomer (a) and the (meth)acrylic acid alkyl esters (c) and (d) as constituent monomers in one molecule, the present invention uses two copolymers (A) and (B) in a specific range of a weight average molecular weight ratio {(A)/(B)} at a specific weight ratio (A/B), wherein the copolymer (A) contains the monomer (a) as a constituent monomer and the copolymer (B) contains the (meth)acrylic acid alkyl esters (c) and (d) as constituent monomers. Such use was found to result in a lubricating oil composition in which the high temperature high shear (HTHS) viscosity at 100° C. is low, the shear stability is excellent, the increase in viscosity at low temperatures is suppressed, and the low temperature viscosity is excellent.

[Chem. 2]

(1)

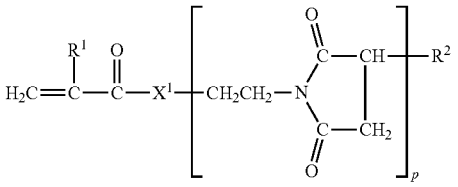

In the formula (1), $R^1$ is a hydrogen atom or a methyl group; —$X^1$— is a group represented by —O—, —$O(AO)_m$—, or —NH—, A is a C2-C4 alkylene group, m is an integer of 1 to 10, and each A may be the same or different when m is 2 or greater; $R^2$ is a residue after removal of one hydrogen atom from a hydrocarbon polymer containing at least one of an isobutylene group or a 1,2-butylene group as a structural unit; and p represents a number of 0 or 1.

<Copolymer (A)>

The viscosity index improver composition (C) of the present invention contains the copolymer (A) containing the polyolefin-based monomer (a) (also referred to as the monomer (a)) represented by the above formula (1) as a constituent monomer.

The monomer (a) constituting the copolymer (A) is represented by the above formula (1).

$R^1$ in the formula (1) is a hydrogen atom or a methyl group. Of these, a methyl group is preferred in terms of viscosity index improving effect.

—$X^1$— in the formula (1) is a group represented by —O—, —$O(AO)_m$—, or NH—.

A is a C2-C4 alkylene group. Examples include an ethylene group, a 1,2- or 1,3-propylene group, and a 1,2-, 1,3-, or 1,4-butylene group. Preferably, A is an ethylene group. AO is a C2-C4 alkyleneoxy group. Examples include an ethyleneoxy group, a 1,2- or 1,3-propyleneoxy group, and a 1,2-, 1,3-, or 1,4-butyleneoxy group.

m is the number of moles of an alkylene oxide added, and it is an integer of 1 to 10. In terms of viscosity index improving effect, it is an integer of preferably 1 to 4, more preferably 1 or 2.

Each A may be the same or different when m is 2 or greater, and AO's in the $(AO)_m$ moiety may be bonded in a random form or a block form.

In terms of viscosity index improving effect, —$X^1$— is preferably a group represented by —O— or —$O(AO)_m$—, more preferably —O— or —$O(CH_2CH_2O)_l$—.

p is a number of 0 or 1.

$R^2$ in the formula (1) is a residue after removal of one hydrogen atom from a hydrocarbon polymer containing at least one of an isobutylene group or a 1,2-butylene group as a structural unit. The hydrocarbon polymer in the formula (1) is one having a carbon number greater than 20.

The isobutylene group is a group represented by —$CH_2C(CH_3)_2$— or —$C(CH_3)_2CH_2$—. The 1,2-butylene group is a group represented by —$CH_2CH(CH_2CH_3)$— or —$CH(CH_2CH)CH_2$—.

Examples of the hydrocarbon polymer containing at least one of an isobutylene group or a 1,2-butylene group as a structural unit include a polymer containing isobutene and 1-butene as constituent monomers (unsaturated hydrocarbons (x)) and a polymer obtained by polymerizing 1,3-butadiene and hydrogenating the double bond of a 1,2-adduct of the polymerized 1,3-butadiene.

The hydrocarbon polymer may also contain at least one of the following (1) to (3) unsaturated hydrocarbons (x) as a constituent monomer, in addition to isobutene, 1-butene, and 1,3-butadiene.

(1) An aliphatic unsaturated hydrocarbon (e.g., C2-C36 olefins (e.g., ethylene, propylene, 2-butene, pentene, heptene, diisobutylene, octene, dodecene, octadecene, triacontene, and hexatriacontene) and C4-C36 dienes (e.g., isoprene, 1,4-pentadiene, 1,5-hexadiene, and 1,7-octadiene))

(2) An alicyclic unsaturated hydrocarbon (e.g., cyclohexene, (di)cyclopentadiene, pinene, limonene, indene, vinylcyclohexene, and ethylidenebicycloheptene)

(3) An aromatic group-containing unsaturated hydrocarbon (e.g., styrene, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, vinylnaphthalene, divinylbenzene, divinyltoluene, divinylxylene, and trivinylbenzene).

A hydrocarbon polymer composed of any of these monomers may be a block polymer or a random polymer. When the hydrocarbon polymer has a double bond, the double bond may be partially or completely hydrogenated by adding hydrogen. In one embodiment, the hydrocarbon polymer in $R^2$ may be a hydrocarbon polymer containing only a C4 monomer as a constituent monomer, and the C4 monomer may be at least one selected from the group consisting of isobutene, 1-butene, and 1,3-butadiene.

The weight average molecular weight (hereinafter abbreviated as Mw) and the number average molecular weight (hereinafter abbreviated as Mn) of the monomer (a) can be measured by gel permeation chromatography (hereinafter abbreviated as GPC) under the following conditions.

<Measuring Conditions for Mw and Mn of Monomer (a)>

Device: "HLC-8320GPC" (available from Tosob Corporation)

Column: "TSKgel GMKXL" (available from Tosoh Corporation) two columns

"TSKgel Multipore $H_{XL}$-M" (available from Tosoh Corporation) one column

Measurement temperature: 40° C.

Sample solution: tetrahydrofuran solution with a sample concentration of 0.25 wt %

Volume of solution injected: 10.0 μl

Detecting device: refractive index detector

Reference material: standard polystyrene (TS reference material: standard polystyrene (TSKstandard POLYSTYRENE) 12 samples (molecular weight: 589, 1,050, 2,630, 9,100, 19,500, 37,900, 96,400, 190,000, 355,000, 1,090,000, 2,110,000, 4,480,000) (available from Tosoh Corporation)

The Mn of the monomer (a) is preferably 800 to 10,000, more preferably 1,000 to 9,000, still more preferably 1,200 to 8,500. The monomer (a) having a Mn of 800 or more tends to result in good viscosity index improving effect. The monomer (a) having a Mn of 10,000 or less tends to result in good shear stability during long time use.

The monomer (a) can be obtained by esterification of a polymer (Y) having a hydroxy group at one end obtained by introducing a hydroxy group to one end of a hydrocarbon polymer with (meth)acrylic acid, or can be obtained by transesterification of the polymer (Y) with a (meth)acrylic alkyl (preferably C1-C4) ester, such as methyl (meth)acrylate. The "(meth)acrylic acid" refers to acrylic acid and/or methacrylic acid.

In terms of solubility in the lubricating oil, preferably, the polymer (Y) is one having a specific range of solubility parameter (sometimes abbreviated as SP). The range of SP of the polymer (Y) is preferably 7.0 to 9.0 $(cal/cm^3)^{1/2}$, more preferably 7.3 to 8.5 $(cal/cm^3)^{1/2}$.

The SP in the present invention is a value calculated by the Fedors method (described in Polymer Engineering and Science, February 1974, Vol. 14, No. 2, pp. 147 to 154).

The SP of the polymer (Y) can be adjusted to a desired range by suitably adjusting the SP and the mole fraction of the monomers to be used.

Specific examples of the polymer (Y) having a hydroxy group at one end include the following (Y1) to (Y4).

Alkylene oxide adduct (Y1): Examples include a product obtained by adding an alkylene oxide (e.g., ethylene oxide or propylene oxide) to a hydrocarbon polymer obtained by polymerizing the unsaturated hydrocarbon (x) in the presence of an ionic polymerization catalyst (e.g., sodium catalyst). In this case, the monomer (a) is a compound represented by the formula (1) in which —$X^1$— is -$(AO)_m$- and p is 0.

Hydroborated product (Y2): Examples include a product obtained by hydroboration of a hydrocarbon polymer of the unsaturated hydrocarbon (x) having a double bond at one end (e.g., the one disclosed in U.S. Pat. No. 4,316,973). In this case, the monomer (a) is a compound represented by the formula (1) in which —$X^1$— is —O— and p is 0.

Maleic anhydride-ene-amino alcohol adduct (Y3): Examples include a product obtained by amino alcohol-mediated imidization of a reaction product obtained by an ene reaction of a hydrocarbon polymer of the unsaturated hydrocarbon (x) having a double bond at one end with maleic anhydride. In this case, the monomer (a) is a compound represented by the formula (1) in which —$X^1$— is —O— and p is 1.

Hydroformylated-hydrogenated product (Y4): Examples include a product obtained by hydroformylation of a hydrocarbon polymer of the unsaturated hydrocarbon (x) having a double bond at one end, followed by hydrogenation (e.g., the one disclosed in JP 563-175096 A). In this case, the monomer (a) is a compound represented by the formula (1) in which —$X^1$— is —O— and p is 0.

In terms of HTHS viscosity and viscosity index improving effect, the polymer (Y) having a hydroxy group at one end is preferably the alkylene oxide adduct (Y1), the hydroborated product (Y2), or the maleic anhydride-ene-amino alcohol adduct (Y3), more preferably the alkylene oxide adduct (Y1).

In terms of viscosity index improving effect, the proportion of butadiene of all the monomers constituting $R^2$ in the formula (1) (i.e., the weight percentage of 1,3-butadiene of all the constituent monomers in the hydrocarbon polymer containing at least one of an isobutylene group or a 1,2-butylene group as a structural unit) is preferably 50 wt % or more, more preferably 75 wt % or more, still more preferably 85 wt % or more, particularly preferably 90 wt % or more.

In the hydrocarbon polymer containing at least one of an isobutylene group or a 1,2-butylene group as a structural unit in the formula (1), in terms of viscosity index improving effect and shear stability, the total amount of the isobutylene group and the 1,2-butylene group is preferably 30 mol % or more, more preferably 40 mol % or more, still more preferably 50 mol % or more based on the total number of moles of the structural units of the hydrocarbon polymer.

For example, the following methods can be employed to increase the proportion of the total amount of the isobutylene group and the 1,2-butylene group in the hydrocarbon polymer. In the case of the alkylene oxide adduct (Y1), for example, anionic polymerization is carried out using 1,3-butadiene by setting the reaction temperature to a temperature not higher than the boiling temperature (−4.4° C.) of 1,3-butadiene, and using a polymerization initiator in an amount smaller than that of 1,3-butadiene, whereby the proportion of the total amount of the isobutylene group and the 1,2-butylene group in the hydrocarbon polymer can be increased. In the case of the hydroborated product (Y2), the maleic anhydride-ene-amino alcohol adduct (Y3), and the hydroformylated-hydrogenated product (Y4), the polymerization degree of the hydrocarbon polymer having a double bond at one end is increased, whereby the proportion can be increased.

In the hydrocarbon polymer containing at least one of an isobutylene group or a 1,2-butylene group as a structural unit in the formula (1), the total amount of the isobutylene group and the 1,2-butylene group can be measured by $^{13}C$-NMR. Specifically, for example, when only a monomer having a carbon number of 4 is used, the hydrocarbon polymer is analyzed by $^{13}C$-NMR, and the following mathematical formula (1) is used for calculation, whereby the total molar percentage (mol %) of the isobutylene group and the 1,2-butylene group based on the total number of moles of the structural units of the hydrocarbon polymer can be determined. In $^{13}C$-NMR, a peak derived from methyl groups of the isobutylene group appears at an integral value of 30 to 32 ppm (integral value A), and a peak derived from branched methylene groups (—$CH_2CH(CH_4CH_3)$— or —$CH(CH_2CH_3)CH_2$—) of the 1,2-butylene group appears at an integral value of 26 to 27 ppm (integral value B). The total molar percentage (mol %) of the isobutylene group and the 1,2-butylene group based on the total number of moles of the structural units of the hydrocarbon polymer can be determined from the integrate values of the peaks and an integral value (integral value C) of all carbon peaks of the hydrocarbon polymer.

$$\text{Total amount of isobutylene group and 1,2-butylene group (mol \%)} = 100\times\{(\text{integral value } A)\times 2 + (\text{integral value } B)\times 4\}/(\text{integral value } C) \quad (1)$$

When the hydrocarbon polymer in $R^2$ contains butadiene as a constituent monomer or butadiene and 1-butene as constituent monomers, in terms of viscosity index improving effect and low temperature viscosity, the molar ratio of a 1,2-adduct to a 1,4-adduct (1,2-adduct/1,4-adduct) in a structure derived from butadiene or from butadiene and 1-butene constituting a part or the whole of $R^2$ in the formula (1) is preferably 5/95 to 95/5, more preferably 20/80 to 80/20, still more preferably 30/70 to 70/30.

When the hydrocarbon polymer in $R^2$ contains butadiene as a constituent monomer or butadiene and 1-butene as constituent monomers, the molar ratio of a 1,2-adduct to a 1,4-adduct in a structure derived from butadiene or from butadiene and 1-butene constituting a part or the whole of $R^2$ in the formula (1) can be measured by $^1$H-NMR, $^{13}$C-NMR, Raman spectroscopy, or the like.

In terms of HTHS viscosity, shear stability, and low temperature viscosity, the copolymer (A) in the present invention is preferably a copolymer containing the monomer (b) represented by the following formula (2) as a constituent monomer:

[Chem. 3]

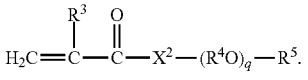

(2)

In the formula, $R^3$ is a hydrogen atom or a methyl group; —$X^1$— is a group represented by —O— or —NH—; $R^4$ is a C2-C4 alkylene group; $R^5$ is a C1-C8 alkyl group; q is an integer of 1 to 20, and each $R^4$ may be the same or different when q is 2 or greater.

$R^3$ in the formula (2) is a hydrogen atom or a methyl group. Of these, a methyl group is preferred in terms of viscosity index improving effect.

—$X^2$— in the formula (2) is a group represented by —O— or —NH—. Of these, a group represented by —O— is preferred in terms of viscosity index improving effect.

$R^4$ in the formula (2) is a C2-C4 alkylene group. Examples of the C2-C4 alkylene group include an ethylene group, an isopropylene group, a 1,2- or 1,3-propylene group, an isobutylene group, and a 1,2-, 1,3-, or 1,4-butylene group.

q in the formula (2) is an integer of 1 to 20. In terms of viscosity index improving effect and low temperature viscosity, it is an integer of preferably 1 to 5, more preferably 1 or 2.

Each $R^4$ may be the same or different when q is 2 or greater, and $R^4O$'s in the $(R^4O)_q$ moiety may be bonded in a random form or a block form.

$R^5$ in the formula (2) is a C1-C8 alkyl group. Specific examples include methyl, ethyl, n-propyl, isopropyl, n-butyl, isobutyl, t-butyl, n-heptyl, isoheptyl, n-hexyl, 2-ethylhexyl, n-pentyl, and n-octyl groups.

In terms of viscosity index, the C1-C8 alkyl group is preferably a C1-C7 alkyl group, more preferably a C1-C6 alkyl group, still more preferably a C1-C5 alkyl group, particularly preferably a C2 or C4 alkyl group.

Specific examples of the monomer (b) include methoxyethyl (meth)acrylate, ethoxyethyl (meth)acrylate, propoxyethyl (meth)acrylate, butoxyethyl (meth)acrylate, pentyloxyethyl (meth)acrylate, hexyloxyethyl (meth)acrylate, heptyloxyethyl (meth)acrylate, octyloxyethyl (meth)acrylate, methoxypropyl (meth)acrylate, ethoxypropyl (meth) acrylate, propoxypropyl (meth)acrylate, butoxypropyl (meth)acrylate, pentyloxypropyl (meth)acrylate, hexyloxypropyl (meth)acrylate, heptyloxypropyl (meth)acrylate, octyloxypropyl (meth)acrylate, methoxybutyl (meth)acrylate, ethoxybutyl (meth)acrylate, propoxybutyl (meth)acrylate, butoxybutyl (meth)acrylate, pentyloxybutyl (meth) acrylate, hexyloxybutyl (meth)acrylate, heptyloxybutyl (meth)acrylate, octyloxybutyl (meth)acrylate, and esters of (meth)acrylic acid and adducts of 2 to 20 moles of at least one selected from the group consisting of ethylene oxide, propylene oxide, and butylene oxide to C1-C8 alcohols.

In terms of viscosity index improving effect, the monomer (b) is preferably ethoxyethyl (meth)acrylate or butoxyethyl (meth)acrylate.

In terms of viscosity index improving effect and shear stability, the weight percentage of the monomer (a) constituting the copolymer. (A) is preferably 1 to 50 wt % more preferably 5 to 40 wt %, still more preferably 10 to 35 wt % based on the weight of the copolymer (A).

The monomer (a) having a weight percentage of 1 wt % or more based on the weight of the copolymer (A) tends to result in good solubility and good long-term use stability, while the monomer (a) having a weight percentage of 50 wt % or less tends to result in excellent viscosity index improving effect.

In the copolymer (A), in terms of viscosity index improving effect, the weight percentage of the monomer (b) among the constituent monomers of the copolymer (A) is preferably 1 to 80 wt %, more preferably 3 to 60 wt %, still more preferably, 5 to 60 wt %, particularly preferably 5 to 40 wt % based on the weight of the copolymer (A).

In terms of viscosity index improving effect and shear stability, the total weight percentage of the monomers (a) and (b) in the copolymer (A) is preferably 10 wt % or more, more preferably 15 to 70 wt %, still more preferably 20 to 60 wt % based on the weight of the copolymer (A).

In terms of viscosity index improving effect, preferably, the copolymer (A) in the present invention is a copolymer containing a (meth)acrylic acid alkyl ester (e) having a C1-C4 alkyl group (hereinafter also referred to as the monomer (e)) excluding the monomer (b) as a constituent monomer, in addition to the monomer (a) and the monomer (b). Examples of the (meth)acrylic acid alkyl ester (e) having a C1-C4 alkyl group include methyl (meth)acrylate, ethyl (meth)acrylate, propyl (meth)acrylate, and butyl (meth)acrylate.

The monomer (e) is preferably methyl (meth)acrylate, ethyl (meth)acrylate, or butyl (meth)acrylate, more preferably ethyl (meth)acrylate or butyl (meth)acrylate.

In the copolymer (A), in terms of HTHS viscosity and viscosity index improving effect, the weight percentage of the monomer (e) among the constituent monomers of the copolymer (A) is preferably 1 to 90 wt %, more preferably 30 to 85 wt %, still more preferably 40 to 80 wt % based on the weight of the copolymer (A).

The copolymer (A) in the present invention may further contain at least one monomer selected from the group consisting of a nitrogen atom-containing monomer (f), a hydroxy group-containing monomer (g), a phosphorus atom-containing monomer (h), and an aromatic ring-containing vinyl monomer (i) as a constituent monomer, in addition to the monomers (a), (b), and (e). Examples of the nitrogen atom-containing monomer (f) (also referred to as the monomer (f)) include the following monomers (f1) to (f4) excluding the monomer (a), the monomer (b), and the monomer (e).

Amide Group-Containing Monomer (f1)

Examples include (meth)acrylamides; monoalkyl (meth) acrylamides (those in which one C1-C4 alkyl group is bonded to a nitrogen atom, such as N-methyl (meth)acrylamide, N-ethyl (meth)acrylamide, N-isopropyl (meth)acrylamide, N-n-butyl (meth)acrylamide, and N-isobutyl (meth) acrylamide); N—(N'-monoalkylaminoalkyl) (meth) acrylamides (those having an aminoalkyl group (C2-C6) in which one C1-C4 alkyl group is bonded to a nitrogen atom, such as N—(N'-methylaminoethyl) (meth)acrylamide, N—(N'-ethylaminoethyl) (meth)acrylamide, N—(N'-isopropylamino-n-butyl) (meth)acrylamide, N—(N'-n-butylamino-n-butyl) (meth)acrylamide, and N—(N'-isobutylamino-n-butyl) (meth)acrylamide); dialkyl (meth) acrylamides (those in which two C1-C4 alkyl groups are bonded to a nitrogen atom, such as N, N-dimethyl (meth) acrylamide, N,N-diethyl (meth)acrylamide, N,N-diisopropyl (meth)acrylamide, and N,N-di-n-butyl (meth)acrylamide); N—(N',N'-dialkylaminoalkyl) (meth)acrylamides (those having an aminoalkyl group (C2-C6) in which two CL-C4 alkyl groups are bonded to a nitrogen atom of an aminoalkyl group, such as N—(N',N'-dimethylaminoethyl) (meth)acrylamide, N—(N',N'-diethylaminoethyl) (meth) acrylamide, N—(N',N'-dimethylaminopropyl) (meth)acrylamide, and N—(N',N'-di-n-butylaminobutyl) (meth)acrylamide); and N-vinyl carboxylic acid amides, such as N-vinylformamide, N-vinylacetamide, N-vinyl-n-propionic acid amide, N-vinyl-isopropionic acid amide, and N-vinylhydroxyacetamide.

Nitro Group-Containing Monomer (f2)

Examples include 4-nitrostyrene.

Primary to tertiary amino group-containing monomer (f3) Examples include primary amino group-containing monomers such as C3-C6 alkenylamines (e.g., (meth)allylamine and crotylamine) and aminoalkyl (C2-C6) (meth)acrylates (e.g., aminoethyl (meth)acrylate); secondary amino group-containing monomers such as monoalkylaminoalkyl (meth) acrylates (e.g., those having an aminoalkyl group (C2-C6) in which one C1-C6 alkyl group is bonded to a nitrogen atom, such as N-t-butylaminoethyl (meth)acrylate and N-methylaminoethyl (meth)acrylate), and C6-C12 dialkenylamines (e.g., di(meth)allylamine); tertiary amino group-containing monomers such as dialkylaminoalkyl (meth)acrylates (e.g., those having an aminoalkyl group (C2-C6) in which two C1-C6 alkyl groups are bonded to a nitrogen atom, such as N,N-dimethylaminoethyl (meth)acrylate and N,N-diethylaminoethyl (meth)acrylate), alicyclic (meth)acrylates having a nitrogen atom such as morpholinoethyl (meth)acrylate, and aromatic monomers such as N—(N',N'-diphenylaminoethyl) (meth)acrylamide, N,N-dimethylaminostyrene, 4-vinylpyridine, 2-vinylpyridine, N-vinylpyrrole, N-vinylpyrrolidone, and N-vinylthiopyrrolidone; and hydrochlorides, sulfates, phosphates, and lower alkyl (C1-C8) monocarboxylic acid (e.g., acetic acid and propionic acid) salts of these monomers.

Nitrile Group-Containing Monomer (f4)

Examples include (meth)acrylonitrile.

The nitrogen atom-containing monomer (f) is preferably the amide group-containing monomer (f1) or the primary to tertiary amino group-containing monomer (f3), more preferably N—(N',N'-diphenylaminoethyl) (meth)acrylamide, N—(N',N'-dimethylaminoethyl) (meth)acrylamide, N—(N',N'-diethylaminoethyl) (meth)acrylamide, N—(N',N'-dimethylaminopropyl) (meth)acrylamide, N,N-dimethylaminoethyl (meth)acrylate, or N,N-diethylaminoethyl (meth) acrylate.

Hydroxy Group-Containing Monomer (g) (Also Referred to as the Monomer (g))

Examples include hydroxy group-containing aromatic monomers (e.g., p-hydroxystyrene), hydroxyalkyl (C2-C6) (meth)acrylates (e.g., 2-hydroxyethyl (meth)acrylate and 2- or 3-hydroxypropyl (meth)acrylate), mono- or bis-hydroxyalkyl (C1-C4) substituted (meth)acrylamides (e.g., N,N-bis (hydroxymethyl) (meth)acrylamide, N,N-bis(hydroxypropyl) (meth)acrylamide, and N,N-bis(2-hydroxybutyl) (meth) acrylamide), vinyl alcohol, C3-C12 alkenols (e.g., (meth) allyl alcohol, crotyl alcohol, isocrotyl alcohol, 1-octenol, and 1-undecenol), C4-C12 alkene monools or alkene diols (e.g., 1-buten-3-ol, 2-buten-1-ol, and 2-butene-1,4-diol), hydroxyalkyl (C1-C6) alkenyl (C3-C10) ethers (e.g., 2-hydroxyethylpropenyl ether), and alkenyl. (C3-C10) ethers or (meth)acrylates of polyhydric (tri- to octahydric) alcohols (e.g., glycerol, pentaerythritol, sorbitol, sorbitan, diglycerol, sugars, and sucrose) (e.g., (meth)allylether of sucrose).

Examples also include mono(meth)acrylates of polyoxyalkylene glycols (carbon number of the alkylene group: C2-C4; polymerization degree: 2 to 50), polyoxyalkylene polyols (polyoxyalkylene ethers (carbon number of the alkylene group: C2-C4; polymerization degree: 2 to 100) of the tri- to octahydric alcohols), or alkyl (C1-C4) ethers of polyoxyalkylene glycols or polyoxyalkylene polyols (e.g., polyethylene glycol (Mn: 100 to 300) mono(meth)acrylate, polypropylene glycol (Mn: 130 to 500) mono(meth)acrylate, methoxy polyethylene glycol (M n: 110 to 310) (meth) acrylate, lauryl alcohol ethylene oxide adduct (2 to 30 moles) (meth)acrylate, and polyoxyethylene (Mn: 150 to 230) sorbitan mono(meth)acrylate).

Examples of the phosphorus atom-containing monomer (h) (also referred to as the monomer (h)) include the following monomers (h1) and (h2).

Phosphate Ester Group-Containing Monomer (h1)

Examples include (meth)acryloyloxyalkyl (C2-C4) phosphate esters ((meth)acryloyloxyethyl phosphate and (meth) acryloyloxy isopropyl phosphate) and alkenyl phosphate esters (e.g., vinyl phosphate, allyl phosphate, propenyl phosphate, isopropenyl phosphate, butenyl phosphate, pentenyl phosphate, octenyl phosphate, decenyl phosphate, and dodecenyl phosphate). The term "(meth)acryloyoxy" means acryloyloxy and/or methacryloyloxy.

Phosphono group-containing monomer (h2) Examples include (meth)acryloyloxy alkyl (C2-C4) phosphonic acids (e.g., (meth)acryloyloxyethyl phosphonic acid) and alkenyl (C2-C12) phosphonic acids (e.g., vinylphosphonic acid, allylphosphonic acid, and octenylphosphonic acid).

The phosphorus atom-containing monomer (h) is preferably the phosphate ester group-containing monomer (h1), more preferably a (meth)acryloyloxyalkyl (C2-C4) phosphate ester, still more preferably (meth)acryloyloxyethyl phosphate.

Aromatic Ring-Containing Vinyl Monomer (i) (Also Referred to as the Monomer (i))

Examples include styrene, α-methylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, 4-crotylbenzene, indene, and 2-vinylnaphthalene.

The aromatic ring-containing vinyl monomer (i) is preferably styrene or α-methylstyrene, more preferably styrene.

In the copolymer (A), in terms of HTHS viscosity and low temperature viscosity, the weight percentage of the monomer (f) among the constituent monomers of the copolymer (A) is preferably 0 to 15 wt %, more preferably 1 to 10 wt % based on the weight of the copolymer (A).

In the copolymer (A), in terms of HTHS viscosity and low temperature viscosity, the weight percentage of the monomer (g) among the constituent monomers of the copolymer (A) is preferably 0 to 15 wt %, more preferably 1 to 10 wt % based on the weight of the copolymer (A).

In the copolymer (A), in terms of HTHS viscosity and low temperature viscosity, the weight percentage of the monomer (h) among the constituent monomers of the copolymer (A) is preferably 0 to 15 wt %, more preferably 1 to 10 wt % based on the weight of the copolymer (A).

In the copolymer (A), in terms of HTHS viscosity and low temperature viscosity, the weight percentage of the monomer (i) among the constituent monomers of the copolymer (A) is preferably 0 to 15 wt %, more preferably 1 to 10 wt % based on the weight of the copolymer (A).

The copolymer (A) may further contain a monomer (j) having two or more unsaturated groups (also referred to as the monomer (j)) as a constituent monomer, in addition to the monomers (a), (b), and (e) to (i).

Examples of the monomer (j) having two or more unsaturated groups include divinylbenzene, C4-C12 alkadienes (e.g., butadiene, isoprene, 1,4-pentadiene, 1,6-heptadiene, and 1,7-octadiene), (di)cyclopentadiene, vinylcyclohexene, ethylidenebicycloheptene, limonene, ethylene di(meth)acrylate, polyalkylene oxide glycol di(meth)acrylate, pentaerythritol triallyl ether, pentaerythritol tri(meth)acrylate, pentaerythritol tetra(meth)acrylate, trimethylolpropane tri(meth)acrylate, and esters disclosed in WO 01/009242 such as an ester of an unsaturated carboxylic acid having a Mn of 500 or more and glycol and an ester of an unsaturated alcohol and a carboxylic acid.

In the copolymer (A), in terms of HTHS viscosity and low temperature viscosity, the weight percentage of the monomer (j) among the constituent monomers of the copolymer (A) is preferably 0 to 15 wt %, more preferably 1 to 10 wt; based on the weight of the copolymer (A).

The copolymer (A) may contain at least one of the following monomers (k) to (n) and a monomer (o) described later as constituent monomers, in addition to the monomers (a), (b), and (e) to (j).

Vinyl Esters, Vinyl Ethers, Vinyl Ketones (k) (Also Referred to as the Monomer (k))

Examples include vinyl esters of C2-C12 saturated fatty acids (e.g., vinyl acetate, vinyl propionate, vinyl butyrate, and vinyl octanoate), C1-C12 alkyl, aryl, or alkoxyalkyl vinyl ethers (e.g., methyl vinyl ether, ethyl vinyl ether, propyl vinyl ether, butyl vinyl ether, 2-ethylhexyl vinyl ether, phenyl vinyl ether, vinyl-2-methoxyethyl ether, and vinyl-2-butoxyethyl ether), and C1-C8 alkyl or aryl vinyl ketones (e.g., methyl vinyl ketone, ethyl vinyl ketone, and phenyl vinyl ketone).

Epoxy Group-Containing Monomer (1) (Also Referred to as the Monomer (1))

Examples include glycidyl (meth)acrylate and glycidyl (meth)allyl ether.

Halogen-Containing Monomer (m) (Also Referred to as the Monomer (m))

Examples include vinyl chloride, vinyl bromide, vinylidene chloride, (meth)allyl chloride, and halogenated styrenes (e.g., dichlorostyrene).

Ester of Unsaturated Polycarboxylic Acid (n) (Also Referred to as the Monomer (n))

Examples include alkyl, cycloalkyl, or aralkyl esters of unsaturated polycarboxylic acids (C1-C8 alkyl diesters (dimethyl maleate, dimethyl fumarate, diethyl maleate, and dioctylmaleate) of unsaturated dicarboxylic acids (e.g., maleic acid, fumaric acid, and itaconic acid)).

In the copolymer (A), in terms of viscosity index improving effect and low temperature viscosity, the weight percentage of the monomer (k) among the constituent monomers of the copolymer (A) is preferably 0 to 10 wt %, more preferably 1 to 5 wt % based on the weight of the copolymer (A).

In the copolymer (A), in terms of viscosity index improving effect and low temperature viscosity, the weight percentage of the monomer (1) among the constituent monomers of the copolymer (A) is preferably 0 to 10 wt %, still more preferably 1 to 5 wt % based on the weight of the copolymer (A).

In the copolymer (A), in terms of viscosity index improving effect and low temperature viscosity, the weight percentage of the monomer (m) among the constituent monomers of the copolymer (A) is preferably 0 to 10 wt %, more preferably 1 to 5 wt % based on the weight of the copolymer (A).

In the copolymer (A), in terms of viscosity index improving effect and low temperature viscosity, the weight percentage of the monomer (n) among the constituent monomers of the copolymer (A) is preferably 0 to 10 wt %, more preferably 1 to 5 wt % based on the weight of the copolymer (A).

In the copolymer (A), in terms of viscosity index improving effect and low temperature viscosity, the weight percentage of the monomer (o) among the constituent monomers of the copolymer (A) is preferably 0 to 50 wt %, more preferably 1 to 30 wt % based on the weight of the copolymer (A).

The copolymer (A) may contain either a monomer (c) or a monomer (d) described later as a constituent monomer. Preferred examples of the monomer (c) and the monomer (d) are the same as those of a monomer (c) and a monomer (d) of a copolymer (B) described later.

In the copolymer (A), in terms of viscosity index improving effect and low temperature viscosity, the weight percentage of the monomer (c) among the constituent monomers of the copolymer (A) is preferably 0 to 30 wt %, more preferably 1 to 20 wt % based on the weight of the copolymer (A).

In the copolymer (A), in terms of viscosity index improving effect and low temperature viscosity, the weight percentage of the monomer (d) among the constituent monomers of the copolymer (A) is preferably 0 to 30 wt %, more preferably 1 to 20 wt % based on the weight of the copolymer (A).

The Mw of the copolymer (A) is preferably 150,000 to 1,200,000, more preferably 200,000 to 1,000,000, still more preferably 300,000 to 800,000, particularly preferably 350,000 to 700,000. The copolymer (A) having a Mw of 150,000 or more tends to result in good viscosity temperature characteristic improving effect and good viscosity index improving effect. A viscosity index improver composition containing such a copolymer can provide the viscosity temperature characteristic improving effect, the viscosity index improving effect, and the like even when added in a small amount. Thus, it is advantageous in terms of cost. The copolymer (A) having a Mw of 1,200,000 or less has a high solubility in the base oil, and tends to impart good shear stability to the resulting viscosity index improver composition and a lubricating oil composition containing such a viscosity index improver composition.

The Mn of the copolymer (A) is preferably 10,000 or more, more preferably 30,000 or more, still more preferably 50,000 or more, particularly preferably 100,000 or more. The Mn of the copolymer (A) is preferably 400,000 or less, more preferably 350,000 or less, still more preferably 300,000 or less, particularly preferably 250,000 or less. In one embodiment, the Mn of the copolymer (A) is preferably 10,000 to 400,000, more preferably 30,000 to 350,000, still more preferably 50,000 to 300,000, particularly preferably 100,000 to 250,000.

The copolymer (A) having a Mn of 10,000 or more tends to result in good viscosity temperature characteristic improving effect and good viscosity index improving effect. A viscosity index improver composition containing such a copolymer can provide the viscosity temperature characteristic improving effect, the viscosity index improving effect, and the like even when added in a small amount. Thus, it is advantageous in terms of cost. The copolymer (A) having a Mn of 400,000 or less has a high solubility in the base oil, and the resulting viscosity index improver composition and a lubricating oil composition containing such a viscosity index improver composition tend to have good shear stability.

In terms of shear stability, the Mw/Mn of the copolymer (A) is preferably 1.0 to 5.0, more preferably 1.5 to 4.5.

The Mw, Mn, and Mw/Mn of the copolymer (A) can be measured under the same measurement conditions for the Mw and Mn of the monomer (a).

The copolymer (A) can be obtained by a known production method. Specific examples include a method in which one or more of the monomers are solution-polymerized in a solvent in the presence of a polymerization catalyst. One type of each of these monomers (a) to (o) may be used singly, or two or more types of each of these monomers (a) to (o) may be used. Examples of the solvent include toluene, xylene, C9-C10 alkylbenzenes, methyl ethyl ketone, mineral oils, synthetic oils, and mixtures of these. Examples of the polymerization catalyst include azo catalysts (e.g., 2,2'-azobis(2-methylbutyronitrile) and 2,2'-azobis(2,4-dimethylvaleronitrile)), peroxide catalysts (e.g., benzoyl peroxide, cumyl peroxide, and lauryl peroxide), and redox catalysts (e.g., mixtures of benzoyl peroxide and tertiary amines). A known chain transfer agent (e.g., C2-C20 alkylmercaptans) can also be used in order to further adjust the molecular weight, if necessary. The polymerization temperature is preferably 25° C. to 140° C., more preferably 50° C. to 120° C. The copolymer (A) can also be obtained by bulk polymerization, emulsion polymerization, or suspension polymerization other than the solution polymerization. The polymerization form of the copolymer (A) may be a random addition polymer, an alternating copolymer, a graft copolymer, or a block copolymer.

In terms of solubility in the base oil, the solubility parameter (SP) of the copolymer (A) is preferably 7.0 to 10.0 $(cal/cm^3)^{1/2}$, more preferably 9.0 to 9.5 $(cal/cm^3)^{1/2}$.

The SP of the copolymer can be adjusted by the types and amounts of the monomers to be used. Specifically, use of a large amount of a monomer having a higher SP results in a higher SP, while use of a large amount of a monomer having a lower SP results in a lower SP.

<Copolymer (B)>

The viscosity index improver composition (C) of the present invention contains a copolymer (B) containing a (meth)acrylic acid alkyl ester (c) (also referred to as the monomer (c)) having a C12-C15 straight-chain or branched alkyl group and a (meth)acrylic acid alkyl ester (d) (also referred to as the monomer (d)) having a C16-C20 straight-chain or branched alkyl group as constituent monomers.

In terms of low temperature viscosity, the amount of the monomer (a) as a constituent monomer of the copolymer (B) is preferably less than 1 wt %, more preferably 0 wt % (the monomer (a) is not contained as a constituent monomer) based on the weight of the copolymer (B).

In the monomer (c) and the monomer (d), examples of the (meth)acrylic acid alkyl ester having a branched alkyl group, such as a (meth)acrylic acid alkyl ester (c1) having a C12-C15 branched alkyl group (hereinafter also referred to as the monomer (c1)) and a (meth)acrylic acid alkyl ester (d1) having a C16-C20 branched alkyl group (hereinafter also referred to as the monomer (d1)), include those represented by the following formula (3).

[Chem. 4]

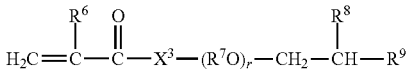

(3)

When the monomer (c1) is a monomer represented by the formula (3), in the formula (3), $R^6$ is a hydrogen atom or a methyl group; —$X^1$— is a group represented by —O—; $R^7O$ is a C2-C4 alkyleneoxy group; $R^8$ and $R^9$ are each independently a C1-C12 straight-chain alkyl group, and the total carbon number of $R^8$ and $R^9$ is 10 to 13; r is an integer of 0 to 20, and each $R^7O$ may be the same or different when r is 2 or greater.

When the monomer (d1) is a monomer represented by the formula (3), in the formula (3), $R^6$ is a hydrogen atom or a methyl group; —$X^1$— is a group represented by —O—; $R^7O$ is a C2-C4 alkyleneoxy group; $R^8$ and $R^9$ are each independently a C1-C17 straight-chain alkyl group, and a total carbon number of $R^8$ and $R^9$ is 14 to 18; and r is an integer of 0 to 20, and each $R^7O$ may be the same or different when r is 2 or greater.

In the monomer (c1) and the monomer (d1), $R^6$ in the formula (3) is a hydrogen atom or a methyl group. Of these, a methyl group is preferred in terms of viscosity index improving effect.

In the monomer (c1) and the monomer (d1), —$X^3$— in the formula (3) is a group represented by —O—. —$X^3$— is preferably a group represented by —O— in terms of viscosity index improving effect.

In the monomer (c1) and the monomer (d1), $R^7$ in the formula (3) is a C2-C4 alkylene group. Examples of the C2-C4 alkylene group include an ethylene group, an isopropylene group, a 1,2- or 1,3-propylene group, an isobutylene group, and a 1,2-, 1,3-, or 1,4-butylene group.

In the monomer (c1) and the monomer (d1), r in the formula (3) is an integer of 0 to 20. In terms of viscosity index improving effect, it is an integer of preferably 0 to 5, more preferably 0 to 2. Each $R^7O$ may be the same or different when r is 2 or greater, and $R^7O$'s in the $(R^7O)_r$ moiety may be bonded in a random form or a block form.

In the monomer (c1), $R^8$ and $R^9$ in the formula (3) are each independently a C1-C12 straight-chain alkyl group. Specific examples of the C1-C12 straight-chain alkyl group include methyl, ethyl, n-propyl, n-butyl, n-heptyl, n-hexyl, n-pentyl, n-octyl, n-nonyl, n-decyl, n-undecyl, and n-dodecyl groups.

In the monomer (d1), $R^8$ and $R^9$ in the formula (3) are each independently a C1-C17 straight-chain alkyl group. Specific examples of the C1-C17 straight-chain alkyl group include methyl, ethyl, n-propyl, n-butyl, n-heptyl, n-hexyl, n-pentyl, n-octyl, n-nonyl, n-decyl, n-undecyl, n-dodecyl, and n-tetradecyl groups.

In the monomer (c1), in terms of viscosity index, $R^8$ and $R^9$ in the formula (3) are each preferably a C1-C10 straight-chain alkyl group among C1-C12 straight-chain alkyl groups.

In the monomer (d1), in terms of viscosity index, $R^8$ and $R^9$ in the formula (3) are each preferably a C4-C10 straight-chain alkyl group among C1-C17 straight-chain alkyl groups.

Specific examples of the (meth)acrylic acid alkyl ester (c) having a C12-C15 straight-chain or branched alkyl group include n-dodecyl (meth)acrylate, n-tridecyl (meth)acrylate, n-tetradecyl (meth)acrylate, n-pentadecyl (meth)acrylate, 2-methylundecyl (meth)acrylate, 2-methyldodecyl (meth)

acrylate, 2-methyltridecyl (meth)acrylate, 2-methyltetradecyl (meth)acrylate, 2-butyloctyl (meth)acrylate, 2-hexylheptyl (meth)acrylate, 2-butylnonyl (meth)acrylate, and an ester of ethylene glycol mono-2-butyldecyl ether and (meth) acryliac acid.

In terms of low temperature viscosity, preferred of these are n-dodecyl (meth)acrylate, n-tridecyl (meth)acrylate, n-tetradecyl (meth)acrylate, n-pentadecyl (meth)acrylate, 2-methylundecyl (meth)acrylate, 2-methyldodecyl (meth) acrylate, 2-methyltridecyl (meth)acrylate, and 2-methyltetradecyl (meth)acrylate.

Specific examples of the (meth)acrylic acid alkyl ester (d) having a C16-C20 straight-chain or branched alkyl group include n-hexadecyl (meth)acrylate, n-heptadecyl (meth) acrylate, n-octadecyl (meth)acrylate, n-nonadecyl (meth) acrylate, n-icosyl (meth)acrylate, 2-octyldecyl (meth)acrylate, 2-octyldodecyl (meth)acrylate, an ester of ethylene glycol mono-2-octyldodecyl ether and (meth)acrylic acid, and N-2-octyldecyl (meth)acrylamide.

In terms of low temperature viscosity, preferred of these are n-hexadecyl (meth)acrylate, n-heptadecyl (meth)acrylate, and n-octadecyl (meth)acrylate.

In the copolymer (B), in terms of low temperature viscosity, the weight percentage of the (meth)acrylic acid alkyl ester (c) having a C12-C15 straight-chain or branched alkyl group among the constituent monomers of the copolymer (B) is preferably 50 to 98 wt %, more preferably 60 to 85 wt % based on the weight of the copolymer (B).

In the copolymer (B), in terms of low temperature viscosity, the weight percentage of the (meth)acrylic acid alkyl ester (d) having a C16-C20 straight-chain or branched alkyl group among the constituent monomers of the copolymer (B) is preferably 2 to 50 wt %, more preferably 15 to 40 wt % based on the weight of the copolymer (B).

The copolymer (B) in the present invention may further contain at least one of the monomers (e) to (n) as a constituent monomer, in addition to the monomer (c) and the monomer (d). Further, the copolymer (B) may contain a (meth)acrylic acid alkyl ester (o) having a C21-C36 straight-chain or branched alkyl group (also referred to as the monomer (o)) as a constituent monomer.

In the monomer (o), examples of the (meth)acrylic acid alkyl ester having a C21-C36 branched alkyl group include those represented by the formula (3) in which $R^8$ and $R^9$ are each independently a C4-C24 straight-chain alkyl group and the total carbon number of $R^8$ and $R^9$ is 19 to 34.

When the monomer (o) is represented by the formula (3), preferably, $R^8$ and $R^9$ in the formula (3) are each independently a C5-C14 straight-chain alkyl group. Specific examples of the C5-C14 straight-chain alkyl group include n-heptyl, n-hexyl, n-pentyl, n-octyl, n-nonyl, n-decyl, n-undecyl, n-dodecyl, n-tetradecyl, n-hexadecyl, n-octadecyl, n-eicosyl, and n-tetracosyl groups.

Specific examples of the (meth)acrylic acid alkyl ester (o) having a C21-C36 straight-chain or branched alkyl group include n-tetracosyl (meth)acrylate, n-triacontyl (meth)acrylate, n-hexatriacontyl (meth)acrylate, 2-decyltetradecyl (meth)acrylate, 2-dodecylhexadecyl (meth)acrylate, 2-tetradecyloctadecyl (meth)acrylate, 2-dodecylpentadecyl (meth) acrylate, 2-tetradecylheptadecyl (meth)acrylate, 2-hexadecylheptadecyl (meth)acrylate, 2-heptadecylicosyl (meth) acrylate, 2-hexadecyldocosyl (meth)acrylate, 2-eicosyldocosyl (meth)acrylate, and 2-tetracosylhexacosyl (meth)acrylate. Preferred of these are 2-decyltetradecyl methacrylate (2-n-decyltetradecyl methacrylate), 2-dodecylhexadecyl methacrylate (2-n-dodecylhexadecyl methacrylate), and the like.

In the copolymer (B), in terms of low temperature viscosity and solubility in the base oil, the weight percentage of the monomer (e) among the constituent monomers of the copolymer (B) is preferably 0 to 20 wt %, more preferably 1 to 15 wt % based on the weight of the copolymer (B).

In the copolymer (B), in terms of low temperature viscosity and solubility in the base oil, the weight percentage of the monomer (f) among the constituent monomers of the copolymer (B) is preferably 0 to 15 wt %, more preferably 1 to 10 wt %, based on the weight of the copolymer (B).

In the copolymer (B), in terms of low temperature viscosity and solubility in the base oil, the weight percentage of the monomer (g) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (h) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (i) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (j) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (k) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (1) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (m) among the constituent monomers of the copolymer (B) is preferably 0 to 15 wt %, more preferably 1 to 10 wt % based on the weight of the copolymer (B).

In the copolymer (B), in terms of low temperature viscosity and solubility in the base oil, the weight percentage of the monomer (n) among the constituent monomers of the copolymer (B) is preferably 0 to 15 wt %, more preferably 1 to 10 wt % based on the weight of the copolymer (B).

In the copolymer (B), in terms of low temperature viscosity, the weight percentage of the monomer (o) among the constituent monomers of the copolymer (B) is preferably 0 to 30 wt %, more preferably 1 to 20 wt % based on the weight of the copolymer (B).

The Mw of the copolymer (B) is preferably 20,000 to 100,000, more preferably 30,000 to 90,000, still more preferably 40,000 to 80,000. The copolymer (B) having a Mw of 20,000 or more tends to result in good viscosity temperature characteristic improving effect and good viscosity index improving effect. A viscosity index improver composition containing such a copolymer can provide the viscosity temperature characteristic improving effect, the viscosity index improving effect, and the like even when added in a small amount. Thus, it is advantageous in terms of cost. The copolymer (B) having a Mw of 100,000 or less tends to impart good shear stability to the resulting viscosity index improver composition and a lubricating oil composition containing such a viscosity index improver composition.

The Mn of the copolymer (B) is preferably 2,000 or more, more preferably 4,000 or more, still more preferably 8,000 or more. The Mn of the copolymer (B) is preferably 70,000 or less, more preferably 50,000 or less, still more preferably 30,000 or less.

The copolymer (B) having a Mn of 2,000 or more tends to result in good viscosity temperature characteristic improving effect and good viscosity index improving effect. A viscosity index improver composition containing such a copolymer can provide the viscosity temperature characteristic improving effect, the viscosity index improving effect, and the like even when added in a small amount. Thus, it is advantageous in terms of cost. The copolymer (B) having a Mn of 70,000 or less tends to impart good shear stability to the resulting viscosity index improver composition and a lubricating oil composition containing such a viscosity index improver composition. In one embodiment, the Mn of copolymer (B) is preferably 2,000 to 70,000, more preferably 4,000 to 50,000, still more preferably 8,000 to 30,000.

In terms of low temperature viscosity, the Mw/Mn of copolymer (B) is preferably 1.0 to 4.0, more preferably 1.5 to 3.0.

The Mw, Mn, and Mw/Mn of the copolymer (B) can be measured under the same measurement conditions for the Mw and Mn of the monomer (a).

In terms of solubility in the base oil, the solubility parameter (SP) of the copolymer (B) is preferably 7.0 to 10.0 $(cal/cm^3)^{1/2}$, more preferably 8.5 to 9.0 $(cal/cm^3)^{1/2}$.

The Mw ratio {(A)/(B)} of the copolymer (A) to the copolymer (B) constituting the viscosity index improver composition (C) of the present invention is 2 to 55. In terms of HTHS viscosity, viscosity index improving effect, shear stability, and low temperature viscosity, the Mw ratio {(A)/(B)} of the copolymer (A) to the copolymer (B) is preferably 5 to 50, more preferably 6 to 35.

The weight ratio (A/B) of the copolymer (A) to the copolymer (B) constituting the viscosity index improver composition (C) of the present invention is 5 to 100. In terms of HTHS viscosity, viscosity index improving effect, and low temperature viscosity, the weight ratio is preferably 10 to 80, more preferably 12 to 50.

A weight ratio (A/B) of 5 or more results in good HTHS viscosity and good viscosity index. A weight ratio (A/B) of 100 or less results in good low temperature viscosity.

In terms of HTHS viscosity, viscosity index improving effect, and low temperature viscosity, the amount of the copolymer (A) in the viscosity index improver composition of the present invention is preferably 15 to 40 wt % based on the weight of the viscosity index improver composition.

In terms of HTHS viscosity, viscosity index improving effect, and low temperature viscosity, the amount of the copolymer (B) in the viscosity index improver composition of the present invention is preferably 0.1 to 8.0 wt %, more preferably 0.15 to 8.0 wt % based on the weight of the viscosity index improver composition.

The viscosity index improver composition (C) of the present invention contains the copolymer (A), the copolymer (B), and a base oil. The base oil may be at least one selected from the group consisting of a base oil of API Groups I to IV, a GTL base oil, and a synthetic lubricating oil base oil (ester-based synthetic base oil). Preferred of these are mineral oils and GTL base oils of Group III. In terms of viscosity index and low temperature fluidity, the kinematic viscosity (measured according to JIS K 2283) at 100° C. of the base oil is preferably 0.1 to 15 $mm^2/s$, more preferably 2 to 5 $mm^2/s$.

In terms of viscosity index and low temperature fluidity of the lubricating oil composition, the viscosity index (measured according to JIS K 2283) of the base oil is preferably 100 or more.

The cloud point (measured according to JIS K 2269) of the base oil is preferably −5° C. or lower, more preferably −15° C. or lower. The base oil having a cloud point in this range tends to impart good low temperature viscosity to the resulting lubricating oil composition.

The viscosity index improver composition (C) of the present invention may be produced by any production method, for example, by mixing the copolymer (A), the copolymer (B), and the base oil.

The lubricating oil composition of the present invention contains the viscosity index improver composition (C) of the present invention, and at least one additive selected from the group consisting of a detergent, a dispersant, an antioxidant, an oiliness improver, a pour point depressant, a friction and wear modifier, an extreme pressure agent, a defoamer, a demulsifier, a metal deactivator, and a corrosion inhibitor.

In terms of HTHS viscosity, viscosity index improving effect, and low temperature viscosity, the amount of the copolymer (A) in the lubricating oil composition of the present invention is preferably 0.5 to 7.0 wt % based on the total weight of the lubricating oil composition.

In terms of HTHS viscosity, viscosity index improving effect, and low temperature viscosity, the amount of the copolymer (B) in the lubricating oil composition of the present invention is preferably 0.01 to 0.7 wt % based on the total weight of the lubricating oil composition.

The lubricating oil composition of the present invention contains one or more additives. Examples of the additives include the followings.

(1) Detergent

Examples include basic, overbased, or neutral metal salts (e.g., overbased metal salts or alkaline earth metal salts of sulfonates such as petroleum sulfonate, alkylbenzene sulfonate, and alkylnaphthalene sulfonate), salicylates, phenates, naphthenates, carbonates, phosphonates, and mixtures of detergents.

(2) Dispersant

Examples include succinimides (bis- or mono-polybutenyl succinimides), Mannich condensates, and borates.

(3) Antioxidant

Examples include hindered phenols and aromatic secondary amines.

(4) Oiliness Improver

Examples include long-chain fatty acids and their esters (e.g., oleic acid and its ester), long-chain amines and their amides (e.g., oleylamine and oleylamide).

(5) Pour Point Depressant

Examples include polyalkylmethacrylates and ethylene-vinyl acetate copolymers.

(6) Friction and Wear Modifier

Examples include molybdenum-based compounds and zinc-based compounds (e.g., molybdenum dithiophosphate, molybdenum dithiocarbamate, and zinc dialkyldithiophosphate).

(7) Extreme Pressure Agent

Examples include sulfur-based compounds (mono- or disulfide, sulfoxide, and sulfur phosphide compounds), phosphide compounds, and chlorinated compounds (e.g., chlorinated paraffin).

(8) Defoamer

Examples include silicone oils, metallic soap, fatty acid esters, and phosphate compounds.

(9) Demulsifier

Examples include quaternary ammonium salts (e.g., tetraalkyl ammonium salt), sulfonated oil and phosphates (e.g., phosphates of polyoxyethylene-containing nonionic surfactant), and hydrocarbon-based solvents (toluene, xylene, and ethyl benzene).

(10) Metal Deactivator

Examples include nitrogen atom-containing compounds (e.g., benzotriazole), nitrogen atom-containing chelate compounds (e.g., N,N'-disalicylidene-1,2-diaminopropane), and nitrogen/sulfur atom-containing compounds (e.g., 2-(n-dodecylthio)benzimidazole).

(11) Corrosion Inhibitor

Examples include nitrogen-containing compounds (e.g., benzotriazole and 1,3,4-thiadiazolyl-2,5-bisdialkyldithiocarbamate).

Only one of these additives may be added, or two or more additives may be added if necessary. A mixture of these additives may be referred to as a performance additive or a package additive, and such a mixture may be added.

Preferably, the amount of each of these additives is 0.1 to 15% by weight based on the total amount of the lubricating oil composition. The total amount of these additives is preferably 0.1 to 30% by weight, more preferably 0.3 to 20% by weight based on the total amount of the lubricating oil composition.

The lubricating oil composition of the present invention is suitably used for gear oils (e.g., differential oil and industrial gear oil), MTF, transmission fluids (e.g., ATF, DCTF, and belt-CVTF), traction fluids (e.g., toroidal-CVTF), shock absorber fluids, power steering fluids, hydraulic oils (e.g., construction machinery hydraulic oil and industrial hydraulic oil), engine oils (e.g., gasoline engine and diesel engine), and the like.

EXAMPLES

The present invention is described in detail below with reference to examples, but the present invention is not limited to these examples.

The molar percentage (mol %) of the total amount of an isobutylene group and a 1,2-butylene group in the structural units of a hydrocarbon polymer was determined by analyzing the polymer by $^{13}$C-NMR and using the mathematical formula (1) by the method described above.

The molar ratio of the 1,2-adduct to the 1,4-adduct in the hydrocarbon polymer (molar ratio in a structure derived from butadiene) was determined by analyzing the polymer by $^{13}$C-NMR and substituting a value of the integral value B and a value of the integral value C used in the above mathematical formula (1) into the following mathematical formula (2).

$$\text{Molar ratio of 1,2-adduct/1,4-adduct}=\{100\times\text{integral value } B\times 2/\text{integral value } C\}/\{100-(100\times\text{integral value } B\times 2/\text{integral value } C)\} \quad (2)$$

The hydroxy value was measured according to JIS K 0070. The acid value was measured according to JIS K 2501.

The crystallization temperature was measured according to JIS K 7121.

The weight average molecular weight (Mw) and the number average molecular weight (Mn) were measured by GPC according to the above methods.

The viscosity index of the base oil was measured by the method of JIS K 2283.

The kinematic viscosity (100° C.) of the base oil was measured according to JIS K 2283.

Production Example 1

A SUS pressure-resistant reaction vessel equipped with a temperature adjuster and a stirrer was charged with degassed and dehydrated hexane (400 parts by weight), tetrahydrofuran (1 part by weight), 1,3-butadiene (75 parts by weight), and n-butyllithium (2 parts by weight), followed by polymerization at a polymerization temperature of 70° C.

After the polymerization proceeded to almost 100%, ethylene oxide (2 parts by weight) was added. The mixture was reacted at 50° C. for three hours. To terminate the reaction, water (50 parts by weight) and a 1 N aqueous hydrochloric acid solution (25 parts by weight) were added to the mixture, followed by stirring at 80° C. for one hour. The organic phase of the reaction solution was collected in a separating funnel, and heated to 70° C. Then, the solvent was removed under reduced pressure of 10 to 20 Torr over two hours.

The resulting polybutadiene having a hydroxy group at one end was transferred to a reaction vessel equipped with a temperature adjuster, a stirrer, and a hydrogen inlet tube, and tetrahydrofuran (150 parts by weight) was added and uniformly dissolved therein. To the resulting solution was added a suspension obtained in advance by mixing palladium on carbon (10 parts by weight) and tetrahydrofuran (50 parts by weight). Then, the mixture was reacted at room temperature for eight hours while hydrogen was supplied at a flow rate of 30 mL/min through the hydrogen inlet tube into the solution. Subsequently, the palladium on carbon was filtered out. The resulting filtrate was heated to 70° C., and tetrahydrofuran was removed under reduced pressure of 10 to 20 Torr. Thus, a hydrogenated polybutadiene polymer (hydrocarbon polymer) having a hydroxy group at one end (Y1-1) (total amount of isobutylene group and 1,2-butylene group: 45 mol %; 1,2-adduct/1,4-adduct (molar ratio): 45/55; hydroxy value: 8.0 mgKOH/g; crystallization temperature: −60° C. or lower) was obtained. A reaction vessel was charged with the hydrogenated polybutadiene polymer having a hydroxy group at one end (Y1-1) (245 parts by weight), methacrylic acid (245 parts by weight), and a sulfonic acid group-carrying inorganic porous material (acid value 45 mgKOH/g; particle size: 240 μm) (98 parts by weight), followed by esterification at 120° C. Then, the sulfonic acid group-carrying inorganic porous material was filtered out, and excess methacrylic acid was removed from the reaction solution under reduced pressure (0.027 to 0.040 MPa). Thus, a monomer (a-1) was obtained. The resulting monomer (a-1) had a Mn of 7,000. The total amount of the isobutylene group and the 1,2-butylene group (45 mol %) is the proportion (mol %) of the total number of moles of the isobutylene group and the 1,2-butylene group based on the total number of moles (100 mol %) of the structural units of the hydrogenated polybutadiene (hydrocarbon polymer) in the polymer (Y1-1).

Production Example 2

A SUS pressure-resistant reaction vessel equipped with a temperature adjuster and a stirrer was charged with degassed and dehydrated hexane (400 parts by weight), tetrahydrofuran (1 part by weight), and n-butyllithium (0.4 parts by weight), followed by cooling to −40° C. 1,3-Butadiene (75 parts by weight) liquefied at −40° C. was added thereto, and the mixture was polymerized at a polymerization temperature of −40° C.

After the polymerization proceeded to almost 100%, ethylene oxide (2 parts by weight) was added. The mixture was heated to 50° C. and reacted for three hours. To terminate the reaction, water (50 parts by weight) and a 1 N aqueous hydrochloric acid solution (25 parts by weight) were added to the mixture, followed by stirring at 80° C. for one hour. The organic phase of the reaction solution was collected in a separating funnel, and heated to 70° C. Then, the solvent was removed under reduced pressure of 10 to 20 Torr over two hours.

The resulting polybutadiene having a hydroxy group at one end was transferred to a reaction vessel equipped with a temperature adjuster, a stirrer, and a hydrogen inlet tube, and tetrahydrofuran (150 parts by weight) was added and uniformly dissolved therein. To the resulting solution was added a suspension obtained in advance by mixing palladium on carbon (10 parts by weight) and tetrahydrofuran (50 parts by weight). Then, the mixture was reacted at room temperature for eight hours while hydrogen was supplied at a flow rate of 30 mL/min through the hydrogen inlet tube into the solution. Subsequently, the palladium on carbon was filtered out. The resulting filtrate was heated to 70° C., and tetrahydrofuran was removed under reduced pressure of 10 to 20 Torr. Thus, a hydrogenated polybutadiene polymer (hydrocarbon polymer) having a hydroxy group at one end (Y1-2) (total amount of isobutylene group and 1,2-butylene group: 65 mol %; 1,2-adduct/1,4-adduct (molar ratio): 65/35; hydroxy value: 8.6 mgKOH/g; crystallization temperature: −60° C. or lower) was obtained. The total amount of the isobutylene group and the 1,2-butylene group (65 mol %) is the proportion (mol %) of the total number of moles of the isobutylene group and the 1,2-butylene group based on the total number of moles (100 mol %) of the structural units of the hydrogenated polybutadiene (hydrocarbon polymer) in the polymer (Y1-2).

A reaction vessel was charged with the hydrogenated polybutadiene polymer having a hydroxy group at one end (Y1-2) (245 parts by weight), methacrylic acid (245 parts by weight), and a sulfonic acid group-carrying inorganic porous material (acid value 45 mgKOH/g; particle size: 240 μm) (98 parts by weight), followed by esterification at 120° C. Then, the sulfonic acid group-carrying inorganic porous material was filtered out, and excess methacrylic acid was removed from the reaction solution under reduced pressure (0.027 to 0.040 MPa). Thus, a monomer (a-2) was obtained. The resulting monomer (a-2) had a Mn of 6,500.

Production Example 3

A reaction vessel equipped with a temperature adjuster, a vacuum stirrer blade, a nitrogen inlet, and a nitrogen outlet was charged with polybutene containing an unsaturated group at an end (product name: "NOF POLYBUTENE 10N" available from NOF Corporation; Mn: 1,000) (280 parts by weight), a 1 mol/L solution of tetrahydrofuran-boron-tetrahydrofuran (available from FUJIFILM Wako Pure Chemical Corporation) (400 parts by weight), and tetrahydrofuran (400 parts by weight), followed by hydroboration at 25° C. for four hours. Then, water (50 parts by weight), an aqueous 3 N NaOH solution (50 parts by volume), and 30 wt % hydrogen peroxide (50 parts by volume) were added for oxidation. The supernatant was collected in a separating funnel, and heated to 50° C. Then, tetrahydrofuran was removed at the same temperature under reduce pressure (0.027 to 0.040 MPa) over two hours. Thus, a hydroxy group-containing polymer (Y2-1) (total amount of isobutylene group and 1,2-butylene group: 100 mol %; hydroxy value: 51 mgKOH/g; crystallization temperature: −60° C. or lower) was obtained. The total amount of the isobutylene group and the 1,2-butylene group (100 mol %) is the proportion (mol %) of the total number of moles of the isobutylene group and the 1,2-butylene group based on the total number of moles (100 mol %) of the structural units of the hydroxy group-containing polymer (Y2-1).

A reaction vessel was charged with the hydroxy group-containing polymer (Y2-1) (245 parts by weight), methacrylic acid (245 parts by weight), and a sulfonic acid group-carrying inorganic porous material (acid value: 45 mgKOH/g; particle size: 240 μm) (98 parts by weight), followed by esterification at 120° C. Then, the sulfonic acid group-carrying inorganic porous material was filtered out, and excess methacrylic acid was removed from the resulting reaction solution under reduced pressure (0.027 to 0.040 MPa), whereby a monomer (a-3) was obtained. The resulting monomer (a-3) had a Mn of 1060.

Production Example 4

A SUS pressure-resistant reaction vessel equipped with a temperature adjuster and a stirrer was charged with polybutene containing an unsaturated group at an end (product name: "NOF POLYBUTENE 200N" available from NOF Corporation; Mn: 2,650) (530 parts by weight) and maleic anhydride (available from FUJIFILM Wako Pure Chemical Corporation) (25 parts by weight), followed by heating to 220° C. with stirring and then an ene-reaction at the same temperature for four hours. Then, the mixture was cooled to 25° C., and 2-aminoethanol (20 parts by weight) was added thereto, followed by heating to 130° C. with stirring and then imidization at the same temperature for tour hours. Unreacted maleic anhydride and 2-aminoalcohol were removed at 120° C. to 130° C. under reduced pressure (0.027 to 0.040 MPa) over two hours. Thus, a hydroxy group-containing polymer (Y3-1) was obtained. In the hydroxy group-containing polymer (Y3-1), the total amount of the isobutylene group and the 1,2-butylene group based on the total number of moles of the structural units of the hydrocarbon polymer moiety was 100 mol %. The hydroxy group-containing polymer (Y3-1) had a Mn of 3,000, a hydroxy value of 18.7 mgKOH/g, and a crystallization temperature of −60° C. or lower.

A reaction vessel was charged with the hydroxy group-containing polymer (Y3-1) (245 parts by weight), methacrylic acid (245 parts by weight), and a sulfonic acid group-carrying inorganic porous material (acid value: 45 mgKOH/g; particle size: 240 μm) (98 parts by weight), followed by esterification at 120° C. Then, the sulfonic acid group-carrying inorganic porous material was filtered out, and excess methacrylic acid was removed from the reaction solution under reduced pressure (0.027 to 0.040 MPa). Thus, a monomer (a-4) was obtained. The resulting monomer (a-4) had a Mn of 2710. The total amount of the isobutylene group and the 1,2-butylene group is the proportion (mol %) of the total number of moles of the isobutylene group and the 1,2-butylene group based on the total number of moles (100 mol %) of the structural units of the hydrocarbon polymer moiety of the hydroxy group-containing polymer (Y3-1) excluding the structural unit derived from 2-aminoethanol.

Production Examples 5 to 24: Production of Copolymer (A)

A reaction vessel equipped with a stirrer, a heating and cooling device, a thermometer, and a nitrogen inlet tube was charged with a base oil A (SP: 8.3 $(cal/cm^3)^{1/2}$; kinematic viscosity at 100° C.: 4.2 $mm^2/s$; viscosity index: 128) (375 parts by weight), a monomer formulation shown in Table 1 (125 parts by weight), 2,2'-azobis(2,4-dimethylvaleronitrile) (in an amount shown in Table 1), and 2,2'-azobis(2-methylbutyronitrile) (in an amount shown in Table 1). After purging with nitrogen (gas phase oxygen concentration: 100 ppm), the mixture was heated to 76° C. with stirring under hermetically sealed conditions, and polymerized at the same temperature for four hours. After heating to 120° C. to 130° C., unreacted monomers were removed at the same temperature under reduced pressure (0.027 to 0.040 MPa) over two hours. Thus, copolymer compositions (1) to (20) respectively containing copolymers (A1) to (A20) each having a concentration of 25 wt % in the base oil were separately obtained. The SP of each of the copolymers in the resulting copolymer compositions (1) to (20) was calculated by the method described above, and the Mw and Mw/Mn of each copolymer was measured by the method described above. The solubility of each copolymer (A) in the base oil was evaluated by the following method. Table 1 shows the results.

Production Examples 25 to 29: Production of Copolymer (B)

A reaction vessel equipped with a stirrer, a heating and cooling device, a thermometer, a dropping funnel, a nitrogen inlet tube, and a decompressor was charged with a base oil A (SP: 8.3 $(cal/cm^3)^{1/2}$; kinematic viscosity at 100° C.: 4.2 $mm^2/s$; viscosity index: 128) (75 parts by weight). Separately, a glass beaker was charged with a monomer formulation shown in Table 2 (325 parts by weight), dodecylmercaptan as a chain transfer agent (in an amount shown in Table 2), 2,2'-azobis(2,4-dimethylvaleronitrile) (in an amount shown in Table 2), and 2,2'-azobis(2-methylbutyronitrile) (in an amount shown in Table 2), followed by stirring at 20° C. and mixing to prepare a monomer solution. The monomer solution was added to the reaction vessel through the dropping funnel.

After purging the gas phase in the reaction vessel with nitrogen (gas phase oxygen concentration: 100 ppm or less), the monomer solution was added dropwise over two hours with the temperature in the system maintained at 70° C. to 85° C. under hermetically sealed conditions. The mixture was aged at 85° C. for two hours after completion of the dropwise addition. Subsequently, after heating to 120° C. to 130° C., unreacted monomers were removed at the same temperature under reduced pressure (0.027 to 0.040 MPa) over two hours. Thus, copolymer compositions (21) to (25) respectively containing copolymers (B1) to (B5) each having a concentration of 65 wt % in the base oil were separately obtained. The SP of each of the copolymer (B) in the resulting copolymer compositions (21) to (25) was calculated by the method described above, and the Mw and Mw/Mn of the copolymer (B) was measured by the method described above. The solubility of the copolymer (B) in the base oil was measured by the following method. Table 2 shows the results.

<Method of Measuring Solubility of Copolymers (A) and (B) in Base Oil>

The appearance of each of the copolymer compositions (1) to (25) was visually observed, and the solubility in the base oil was evaluated based on the following evaluation criteria.

Evaluation Criteria

Good: Uniform appearance without insoluble fractions of the copolymer

Poor: Non-uniform appearance with insoluble fractions of the copolymer

TABLE 1

| | | Production Example | | | | | | | | | |
|---|---|---|---|---|---|---|---|---|---|---|---|
| | | 5 | 6 | 7 | 8 | 9 | 10 | 11 | 12 | 13 | 14 |
| Copolymer composition | | 1 | 2 | 3 | 4 | 5 | 6 | 7 | 8 | 9 | 10 |
| Copolymer | | (A1) | (A2) | (A3) | (A4) | (A5) | (A6) | (A7) | (A8) | (A9) | (A10) |
| Monomer formulation (parts by weight) | (a-1) | | | 13 | 6 | 7.5 | 7 | 7 | | 15 | |
| | (a-2) | | | | 6 | 7.5 | 7.5 | 7.5 | 15 | | 11.5 |
| | (a-3) | 5 | | | | | | | 10 | | |
| | (a-4) | | 10 | | | | | | | | |
| | (b-1) | 10 | | 15 | | | | | 10 | | |
| | (b-2) | | 25 | | 15 | 10 | 10 | 10 | | 10 | 14 |
| | (c-1) | 5 | | | 4 | 4 | 4 | 4 | 7 | 5 | 6 |
| | (c-2) | | | | 1 | 1 | 1 | 1 | | | |
| | (c-3) | 5 | | | 4 | 4 | 4 | 4 | 3 | 5 | 5 |
| | (c-4) | | | | 1 | 1 | 1 | 1 | | | |
| | (c-5) | | | | | 2.5 | 2.5 | 2.5 | | 2.5 | |
| | (c-6) | | | | | | | | | | |
| | (c-7) | | | | | 2.5 | 2.5 | 2.5 | | 2.5 | |
| | (c-8) | | | | | | | | | | |
| | (e-1) | 20 | 15 | | | | | | 45 | 80 | 63.5 |
| | (e-2) | 30 | 25 | 42 | 63 | 60 | 60.5 | 60.5 | | | |
| | (f-1) | | 5 | | | | | | | | |
| | (g-1) | | | 2 | | | | | | | |
| | (h-1) | | | | | | | | 1 | | |
| | (o-1) | 25 | | 14 | | | | | 4 | | |
| | (o-2) | | 20 | 14 | | | | | 5 | | |
| | Subtotal | 100 | 100 | 100 | 100 | 100 | 100 | 100 | 100 | 100 | 100 |
| Dodecylmercaptan (parts by weight) | | — | — | — | — | — | — | — | — | — | — |
| 2.2'-Azobis(2,4-dimethylvaleronitrile (parts by weight) | | — | — | — | — | — | — | — | 0.10 | — | — |

TABLE 1-continued

| | | | | | | | | | | | |
|---|---|---|---|---|---|---|---|---|---|---|---|
| 2,2'-Azobis(2-methylbutyronitrile) (parts by weight) | | 0.105 | 0.160 | 0.130 | 0.095 | 0.105 | 0.130 | 0.150 | 0.250 | 0.085 | 0.075 |
| SP of (A) | | 9.23 | 9.21 | 9.22 | 9.27 | 9.21 | 9.21 | 9.21 | 9.15 | 9.21 | 9.27 |
| Solubility in base oil | | Good | Good | Good | Good | Good | Good | Good | Good | Good | Good |
| Mw/Mn of (A) | | 2.99 | 2.67 | 2.73 | 2.91 | 2.85 | 2.70 | 2.68 | 1.91 | 3.08 | 3.03 |
| Mw ($\times 10^4$) or (A) | | 55 | 42 | 48 | 65 | 50 | 47 | 44 | 18 | 110 | 95 |
| | | Production Example | | | | | | | | | |
| | | 15 | 16 | 17 | 18 | 19 | 20 | 21 | 22 | 23 | 24 |
| Copolymer composition | | 11 | 12 | 13 | 14 | 15 | 16 | 17 | 18 | 19 | 20 |
| Copolymer | | (A11) | (A12) | (A13) | (A14) | (A15) | (A16) | (A17) | (A18) | (A19) | (A20) |
| Monomer formulation (parts by weight) | (a-1) | | 15 | 15 | | | | 15 | 15 | 15 | 7.5 |
| | (a-2) | 10 | | | 15 | 15 | 15 | | | | 7.5 |
| | (a-3) | 10 | | | 10 | 10 | 10 | | | | |
| | (a-4) | | | | | | | | | | |
| | (b-1) | | | | 10 | 10 | 10 | | | | |
| | (b-2) | 3 | 10 | 15 | | | | 15 | 15 | 15 | |
| | (c-1) | 7 | 4 | 5 | 7 | 7 | 7 | 5 | 5 | 5 | 4 |
| | (c-2) | 1.5 | 1 | | | | | | | | 1 |
| | (c-3) | 7 | 4 | 5 | 3 | 3 | 3 | 5 | 5 | 5 | 4 |
| | (c-4) | 1.5 | 1 | | | | | | | | 1 |
| | (c-5) | 2.5 | 2.5 | 2.5 | | | | 2.5 | 2.5 | 2.5 | 2.5 |
| | (c-6) | | | | | | | | | | |
| | (c-7) | 2.5 | 2.5 | 2.5 | | | | 2.5 | 2.5 | 2.5 | 2.5 |
| | (c-8) | | | | | | | | | | |
| | (e-1) | | | | 45 | 45 | 45 | | | | |
| | (e-2) | 55 | 50 | 55 | | | | 55 | 55 | 55 | 70 |
| | (f-1) | | | | | | | | | | |
| | (g-1) | | | | | | | | | | |
| | (h-1) | | | | 1 | 1 | 1 | | | | |
| | (o-1) | | | | 4 | 4 | 4 | | | | |
| | (o-2) | | | | 5 | 5 | 5 | | | | |
| | Subtotal | 100 | 100 | 100 | 100 | 100 | 100 | 100 | 100 | 100 | 100 |
| Dodecylmercaptan (parts by weight) | | — | — | — | — | — | — | — | — | 0.400 | — |
| 2.2'-Azobis(2,4-dimethylvaleronitrile) (parts by weight) | | — | — | — | — | — | — | 0.05 | 0.10 | 0.10 | — |
| 2,2'-Azobis(2-methylbutyronitrile) (parts by weight) | | 0.140 | 0.105 | 0.060 | 0.090 | 0.080 | 0.055 | 0.250 | 0.280 | 0.400 | 0.100 |
| SP of (A) | | 9.12 | 9.21 | 9.21 | 9.15 | 9.15 | 9.15 | 9.12 | 9.12 | 9.12 | 9.21 |
| Solubility in base oil | | Good | Good | Good | Good | Good | Poor | Good | Good | Good | Good |
| Mw/Mn of (A) | | 2.70 | 2.82 | 3.20 | 2.94 | 3.09 | 3.12 | 2.34 | 1.84 | 1.77 | 2.80 |
| Mw ($\times 10^4$) or (A) | | 44 | 50 | 120 | 72 | 120 | 130 | 30 | 15 | 5 | 52 |

TABLE 2

| | | Production Example | | | | |
|---|---|---|---|---|---|---|
| | | 25 | 26 | 27 | 28 | 29 |
| Copolymer composition | | 21 | 22 | 23 | 24 | 25 |
| Copolymer | | (B1) | (B2) | (B3) | (B4) | (B5) |
| Monomer formulation (parts by weight) | (c-1) | 17 | 75 | 23 | 23 | 17 |
| | (c-2) | 3 | | 3 | 3 | 3 |
| | (c-3) | 18 | | 17 | 17 | 18 |
| | (c-4) | 2 | | 4 | 4 | 2 |
| | (c-5) | 20 | 7 | 9 | 9 | 20 |
| | (c-6) | 4 | | 2 | 2 | 4 |
| | (c-7) | 12 | | 9 | 9 | 12 |
| | (c-8) | 4 | | 2 | 2 | 4 |
| | (d-1) | 20 | 13 | 17 | 17 | 20 |
| | (d-2) | | 5 | 14 | 14 | |
| | Subtotal | 100 | 100 | 100 | 100 | 100 |
| Dodecylmercaptan (parts by weight) | | 1.00 | 0.400 | 0.300 | 0.150 | 0.085 |
| 2,2'-Azobis(2,4-dimethylvaleronitrile) (parts by weight) | | 0.050 | 0.050 | 0.040 | 0.040 | 0.050 |

TABLE 2-continued

| | Production Example | | | | |
|---|---|---|---|---|---|
| | 25 | 26 | 27 | 28 | 29 |
| 2.2'-Azobis(2-methylbutyronitrile) (parts by weight) | 0.400 | 0.250 | 0.200 | 0.200 | 0.040 |
| SP of (B) | 8.97 | 9.00 | 8.97 | 8.97 | 8.97 |
| Solubility in base oil | Good | Good | Good | Good | Good |
| Mw/Mn of (B) | 1.67 | 1.90 | 2.02 | 2.09 | 1.80 |
| Mw ($\times 10^4$) of (B) | 2 | 5 | 8 | 10 | 3 |

The monomers (a) to (h) and (o) described in Tables 1 and 2 are as follows.

(a-1): Methacrylic acid ester of the hydrogenated polybutadiene polymer having a hydroxy group at one end (Y1-1) obtained in Production Example 1

(a-2): Methacrylic acid ester of the hydrogenated polybutadiene polymer having a hydroxy group at one end (Y1-2) obtained in Production Example 2

(a-3): Methacrylic acid ester of the hydroxy group-containing polymer (Y2-1) obtained in Production Example 3

(a-4): Methacrylic acid ester of the hydroxy group-containing polymer (Y3-1) obtained in Production Example 4

(b-1): Ethoxyethyl methacrylate
(b-2): Butoxyethyl methacrylate
(c-1): n-Dodecyl methacrylate
(c-2): 2-Methylundecyl methacrylate
(c-3): n-Tridecyl methacrylate
(c-4): 2-Methyldodecyl methacrylate
(c-5): n-Tetradecyl methacrylate
(c-6): 2-Methyltridecyl methacrylate
(c-7): n-Pentadecyl methacrylate
(c-8): 2-Methyltetradecyl methacrylate
(d-1): n-Hexadecyl methacrylate
(d-2): n-Octadecyl methacrylate
(e-1): Methyl methacrylate
(e-2): Butyl methacrylate
(f-1): N,N-dimethylaminoethyl methacrylate
(g-1): 2-Hydroxyethyl methacrylate
(h-1): Methacryloyloxyethyl phosphate
(o-1): 2-n-Decyltetradecyl methacrylate
(o-2): 2-n-Dodecylhexadecyl methacrylate In the following examples and comparative examples, the "part(s)" means "part(s) by weight" unless otherwise specified.

Examples 1 to 22 and Comparative Examples 1 to 5: Evaluation of 0W-16 (SAE J300 Engine Oil Standard)

(1) Production of Viscosity Index Improver Composition

Stainless steel vessels each equipped with a stirrer were charged with the respective copolymer compositions (1) to (25) and a base oil A (SP: 8.3 $(cal/cm^3)^{1/2}$; kinematic viscosity at 100° C.: 4.2 $mm^2/s$; viscosity index: 128) according to Tables 3 and 4. Thus, viscosity index improver compositions (1) to (22) (Examples 1 to 22) and viscosity index improver compositions (1') to (5') (Comparative Examples 1 to 5) were obtained. In Tables 3 and 4, the amounts of the copolymers (A) and (B) in "Amount in viscosity index improver composition" are not the amounts of these copolymer compositions diluted in the base oil but the amount of the copolymer (A) or (B) contained in the viscosity index improver composition. The copolymer (A16) was not used due to its low solubility in the base oil.

(2) Production of Lubricating Oil Composition

A reaction vessel was charged with a base oil. A (SP: 8.3 $(cal/cm^3)^{1/2}$, kinematic viscosity at 100° C.: 4.2 $mm^2/s$, viscosity index: 128) (90 parts) and a package additive (Infineum P5741) (10 parts). Then, the viscosity index improver compositions (1) to (22) and (1') to (5') were added to the respective mixtures to obtain lubricating oil compositions each having a HTHS viscosity at 150° C. of 2.30±0.05 $(mm^3/s)$. Thus, lubricating oil compositions (V1) to (V22) and (W1) to (W5) containing the respective viscosity index improver compositions were obtained. The HTHS viscosity of the lubricating oil composition at 150° C. was measured by the method of ASTM D 4683. The total amount (wt %) of the copolymers (A) and (B) in the lubricating oil composition is as described in Tables 3 and 4.

The HTHS viscosity (100° C.), viscosity index, shear stability, and low temperature viscosity (−40° C.) of the lubricating oil compositions (V1) to (V22) and (W1) to (W5) were measured by the following methods. Tables 3 and 4 show the results.

<Method of Measuring HTHS Viscosity of Lubricating Oil Composition>

The HTHS viscosity was measured at 100° C. by the method of ASTM D 4683. A lower HTHS viscosity means a better HTHS viscosity reducing effect at 100° C. In this evaluation, the HTHS viscosity reducing effect was evaluated as follows based on the HTHS viscosity at 100° C.: more than 4.55 mPa·s: poor; 4.55 mPa·s or less: good; 4.45 mPa s or less: very good; and 4.35 mPa·s or less: excellent.

<Method of Calculating Viscosity Index of Lubricating Oil Composition>

The kinematic viscosity was measured at 40° C. and 100° C. by the method of JIS K 2283, and the viscosity index was calculated by the method of JIS K 2283. A greater viscosity index means a higher viscosity index improving effect. In this evaluation, the viscosity index improving effect was evaluated as follows based on the viscosity index: lower than 170: poor, 170 or higher: good; 200 or higher: very good; and 230 or higher: excellent.

<Methods of Measuring and Calculating Shear Stability of Lubricating Oil Composition>

Evaluation was performed according to JPI-5S-29-2006. A smaller value means a higher shear stability. In this evaluation, the shear stability was evaluated as follows: more than 14%: poor; 14% or less: good; 10% or less: very good; and 5% or less: excellent.

<Method of Measuring Low Temperature Viscosity of Lubricating Oil Composition>

The viscosity at −40° C.: was measured by the method of JPI-5S-42-2004. A lower value means better low temperature viscosity. In this evaluation, the low temperature viscosity was evaluated as follows based on the viscosity at −40° C.: more than 32000 mPa·s: poor; 32000 mPa·s or less: good; 25000 mPa·s or less: very good; and 20000 mPa·s or less: excellent.

TABLE 3

| | Copolymer composition | Copolymer | Example 1 | 2 | 3 | 4 | 5 | 6 | 7 | 8 |
|---|---|---|---|---|---|---|---|---|---|---|
| Amount in viscosity index improver composition (parts by weight) | 1 | A1 | 20 | | | | | | | |
| | 2 | A2 | | 20 | | | | | | |
| | 3 | A3 | | | 20 | | | | | |
| | 4 | A4 | | | | 20 | | | | |
| | 5 | A5 | | | | | 20 | | | |
| | 6 | A6 | | | | | | 22 | | |
| | 7 | A7 | | | | | | | 22 | |
| | 8 | A8 | | | | | | | | 20 |
| | 9 | A9 | | | | | | | | |
| | 10 | A10 | | | | | | | | |
| | 11 | A11 | | | | | | | | |
| | 12 | A12 | | | | | | | | |
| | 13 | A13 | | | | | | | | |
| | 14 | A14 | | | | | | | | |

TABLE 3-continued

| | | | | | | | | | | |
|---|---|---|---|---|---|---|---|---|---|---|
| | 15 | A15 | | | | | | | | |
| | 17 | A17 | | | | | | | | |
| | 18 | A18 | | | | | | | | |
| | 19 | A19 | | | | | | | | |
| | 20 | A20 | | | | | | | | |
| | 21 | B1 | 0.52 | | | 0.72 | | | | |
| | 22 | B2 | | 1.50 | | | 0.65 | 1.05 | 1.05 | |
| | 23 | B3 | | | 1.37 | | | | | 0.33 |
| | 24 | B4 | | | | | | | | |
| | 25 | B5 | | | | | | | | |
| | Base oil | | 79.48 | 78.50 | 78.63 | 79.28 | 79.35 | 76.95 | 76.95 | 79.67 |
| | Total | | 100 | 100 | 100 | 100 | 100 | 100 | 100 | 100 |
| Weight ratio of (A) to (B) in viscosity index improver composition (A/B) | | | 38 | 13 | 15 | 28 | 31 | 21 | 21 | 62 |
| Mw ratio of (A) to (B) (A/B) | | | 28 | 8.4 | 6.0 | 33 | 10 | 9.4 | 8.8 | 2.3 |
| Viscosity index improver composition | | | 1 | 2 | 3 | 4 | 5 | 6 | 7 | 8 |
| Lubricating oil composition | | | (V1) | (V2) | (V3) | (V4) | (V5) | (V6) | (V7) | (V8) |
| Total amount of copolymers (A) and (B) in lubricating oil composition (wt %) | | | 1.23 | 1.72 | 1.28 | 1.66 | 1.45 | 1.46 | 1.48 | 1.63 |
| Results | HTHS viscosity (100° C.) (mPa · s) | | 4.36 | 4.38 | 4.39 | 4.34 | 4.40 | 4.42 | 4.43 | 4.50 |
| | Viscosity index | | 230 | 212 | 215 | 219 | 215 | 213 | 211 | 177 |
| | Shear stability (%) | | 10 | 7 | 7 | 8 | 6 | 6 | 5 | 3 |
| | Low temperature viscosity (−40° C.) (mPa · s) | | 20,000 | 21,000 | 23,000 | 18,500 | 19,500 | 21,000 | 20,500 | 25,000 |
| Evaluation | HTHS viscosity (100° C.) (mPa · s) | | Very good | Very good | Very good | Excellent | Very good | Very good | Very good | Good |
| | Viscosity index | | Excellent | Very good | Very good | Very good | Very good | Very good | Very good | Good |
| | Shear stability (%) | | Very good | Very good | Very good | Very good | Very good | Very good | Excellent | Excellent |
| | Low temperature viscosity (−40° C.) (mPa · s) | | Excellent | Very good | Very good | Excellent | Excellent | Very good | Very good | Very good |

| | Copolymer composition | Copolymer | Example 9 | 10 | 11 | 12 | 13 | 14 | 15 |
|---|---|---|---|---|---|---|---|---|---|
| Amount in viscosity index improver composition (parts by weight) | 1 | A1 | | | | | | | |
| | 2 | A2 | | | | | | | |
| | 3 | A3 | | | | | | | |
| | 4 | A4 | | | | | | | |
| | 5 | A5 | | | | 20 | 20 | 20 | |
| | 6 | A6 | | | | | | | |
| | 7 | A7 | | | | | | | |
| | 8 | A8 | | | | | | | |
| | 9 | A9 | 20 | | | | | | |
| | 10 | A10 | | 20 | | | | | |
| | 11 | A11 | | | 20 | | | | |
| | 12 | A12 | | | | | | | 20 |
| | 13 | A13 | | | | | | | |
| | 14 | A14 | | | | | | | |
| | 15 | A15 | | | | | | | |
| | 17 | A17 | | | | | | | |
| | 18 | A18 | | | | | | | |
| | 19 | A19 | | | | | | | |
| | 20 | A20 | | | | | | | |
| | 21 | B1 | 1.63 | | | | | | |
| | 22 | B2 | | 0.81 | | 3.90 | 0.20 | 0.98 | 0.65 |
| | 23 | B3 | | | 1.56 | | | | |
| | 24 | B4 | | | | | | | |
| | 25 | B5 | | | | | | | |
| | Base oil | | 78.37 | 79.19 | 78.44 | 76.10 | 79.80 | 79.02 | 79.35 |
| | Total | | 100 | 100 | 100 | 100 | 100 | 100 | 100 |
| Weight ratio of (A) to (B) in viscosity index improver composition (A/B) | | | 12 | 25 | 13 | 5 | 100 | 21 | 31 |
| Mw ratio of (A) to (B) (A/B) | | | 55 | 19 | 5.5 | 10 | 10 | 10 | 10 |
| Viscosity index improver composition | | | 9 | 10 | 11 | 12 | 13 | 14 | 15 |
| Lubricating oil composition | | | (V9) | (V10) | (V11) | (V12) | (V13) | (V14) | (V15) |
| Total amount of copolymers (A) and (B) in lubricating oil composition (wt %) | | | 0.65 | 0.83 | 1.29 | 1.67 | 1.41 | 1.47 | 1.42 |
| Results | HTHS viscosity (100° C.) (mPa · s) | | 4.33 | 4.32 | 4.42 | 4.41 | 4.39 | 4.40 | 4.41 |

TABLE 3-continued

| | | | | | | | | |
|---|---|---|---|---|---|---|---|---|
| | Viscosity index | 276 | 268 | 235 | 214 | 217 | 215 | 216 |
| | Shear stability (%) | 13 | 10 | 5 | 6 | 6 | 6 | 6 |
| | Low temperature viscosity (−40° C.) (mPa · s) | 28,000 | 25,000 | 25,000 | 28,000 | 29,500 | 18,000 | 20,000 |
| Evaluation | HTHS viscosity (100° C.) (mPa · s) | Excellent | Excellent | Very good | Very good | Very good | Very good | Very good |
| | Viscosity index | Excellent | Excellent | Excellent | Very good | Very good | Very good | Very good |
| | Shear stability (%) | Good | Very good | Excellent | Very good | Very good | Very good | Very good |
| | Low temperature viscosity (−40° C.) (mPa · s) | Good | Very good | Very good | Good | Good | Excellent | Excellent |

| | Copolymer composition | Copolymer | Example 16 | 17 | 18 | 19 | 20 | 21 | 22 |
|---|---|---|---|---|---|---|---|---|---|
| Amount in viscosity index improver composition (parts by weight) | 1 | A1 | | | | | | | |
| | 2 | A2 | | | | | | | |
| | 3 | A3 | | | | | | | |
| | 4 | A4 | | | | | | | |
| | 5 | A5 | | 20 | | | | | |
| | 6 | A6 | | | | | | | |
| | 7 | A7 | | | | | | | |
| | 8 | A8 | | | | | | | |
| | 9 | A9 | | | | | | | |
| | 10 | A10 | | | | | | | |
| | 11 | A11 | | | | | | | |
| | 12 | A12 | | | | | | | |
| | 13 | A13 | 20 | | | | | | |
| | 14 | A14 | | | 20 | | | | |
| | 15 | A15 | | | | 20 | | | |
| | 17 | A17 | | | | | 20 | | |
| | 18 | A18 | | | | | | 20 | |
| | 19 | A19 | | | | | | | |
| | 20 | A20 | | | | | | | 20 |
| | 21 | B1 | | | | | | | |
| | 22 | B2 | | | | | | | 0.65 |
| | 23 | B3 | | | 0.33 | 0.33 | | | |
| | 24 | B4 | | 0.65 | | | | | |
| | 25 | B5 | 1.60 | | | | 1.60 | 1.60 | |
| | Base oil | | 78.40 | 79.35 | 79.67 | 79.67 | 78.40 | 78.40 | 79.35 |
| | Total | | 100 | 100 | 100 | 100 | 100 | 100 | 100 |
| Weight ratio of (A) to (B) in viscosity index improver composition (A/B) | | | 13 | 31 | 61 | 61 | 13 | 13 | 31 |
| Mw ratio of (A) to (B) (A/B) | | | 40 | 5.0 | 9.0 | 15 | 10 | 3.0 | 10 |
| Viscosity index improver composition | | | 16 | 17 | 18 | 19 | 20 | 21 | 22 |
| Lubricating oil composition | | | (V16) | (V17) | (V18) | (V19) | (V20) | (V21) | (V22) |
| Total amount of copolymers (A) and (B) in lubricating oil composition (wt %) | | | 0.60 | 1.42 | 0.85 | 0.55 | 1.50 | 1.70 | 1.42 |
| Results | HTHS viscosity (100° C.) (mPa · s) | | 4.31 | 4.42 | 4.40 | 4.36 | 4.44 | 4.55 | 4.42 |
| | Viscosity index | | 279 | 215 | 240 | 290 | 210 | 170 | 212 |
| | Shear stability (%) | | 14 | 6 | 11 | 14 | 6 | 4 | 7 |
| | Low temperature viscosity (−40° C.) (mPa · s) | | 31,000 | 21,000 | 25,000 | 25,000 | 20,000 | 19,000 | 21,000 |
| Evaluation | HTHS viscosity (100° C.) (mPa · s) | | Excellent | Very good | Very good | Very good | Very good | Good | Very good |
| | Viscosity index | | Excellent | Very good | Excellent | Excellent | Very good | Good | Very good |
| | Shear stability (%) | | Good | Very good | Good | Good | Very good | Excellent | Very good |
| | Low temperature viscosity (−40° C.) (mPa · s) | | Good | Very good | Very good | Very good | Excellent | Excellent | Very good |

TABLE 4

| | Copolymer composition | Copolymer | Comparative Example 1 | 2 | 3 | 4 | 5 |
|---|---|---|---|---|---|---|---|
| Amount in viscosity index improver composition | 5 | A5 | 20 | 20 | | | |
| | 8 | A8 | | | 20 | | |
| | 13 | A13 | | | | 20 | |
| | 19 | A19 | | | | | 20 |
| | 21 | B1 | | | | 1.59 | |

TABLE 4-continued

| | Copolymer composition | Copolymer | Comparative Example 1 | 2 | 3 | 4 | 5 |
|---|---|---|---|---|---|---|---|
| (parts by weight) | 22 | B2 | 5.20 | 0.18 | | | |
| | 23 | B3 | | | | | |
| | 24 | B4 | | | 0.33 | | |
| | 25 | B5 | | | | | 1.60 |
| | Base of | | 74.80 | 79.82 | 79.67 | 78.41 | 78.40 |
| | Total | | 100 | 100 | 100 | 100 | 100 |
| Weight ratio of (A) to (B) in viscosity index improver composition (A/B) | | | 4 | 110 | 61 | 13 | 13 |
| Mw ratio of (A) to (B) (A/B) | | | 10 | 10 | 1.8 | 60 | 1.7 |
| Viscosity index improver composition | | | 1' | 2' | 3' | 4' | 5' |
| Lubricating oil composition | | | (W1) | (W2) | (W3) | (W4) | (W5) |
| Total amount of copolymers (A) and (B) in lubricating oil composition (wt %) | | | 1.76 | 1.41 | 1.80 | 0.76 | 1,95 |
| Results | HTHS viscosity (100° C.) (mPa · s) | | 4.48 | 4.45 | 4.52 | 4,41 | 4.65 |
| | Viscosity index | | 170 | 212 | 175 | 268 | 155 |
| | Shear stability (%) | | 8 | 6 | 5 | 17 | 7 |
| | Low temperature viscosity (−40° C.) (mPa · s) | | 38,000 | 40,000 | 35,000 | 52,000 | 64,000 |
| Evaluation | HTHS viscosity (100° C.) (mPa · s) | | Good | Very good | Good | Very good | Poor |
| | Viscosity index | | Good | Very good | Good | Excellent | Poor |
| | Shear stability (%) | | Very good | Very good | Excellent | Poor | Very good |
| | Low temperature viscosity (−40° C.) (mPa · s) | | Poor | Poor | Poor | Poor | Poor |

As shown in the results of Tables 3 and 4, the lubricating oil compositions containing the viscosity index improver compositions of the present invention in which the Mw ratio {(A)/(B)} of the copolymer (A) to the copolymer (B) is 2 to 55 and the weight ratio (A/B) of the copolymer (A) to (B) is 5 to 100 are excellent without being rated "poor" in the evaluation results. The shear stability is excellent, the HTHS viscosity is low, the viscosity index is high, and the low temperature viscosity is low. In particular, comparisons of Examples 5 and 12 to 14 to Comparative Examples 1 and 2, each in which the same copolymer (A) and the same copolymer (B) were used at a different weight ratio (A/B), show that these examples in which the weight ratio (A/B) is 5 to 100 are excellent. The viscosity index is very high and the low temperature viscosity is very low. Comparisons of Examples 8, 18, and 19 to Comparative Example 3 and comparisons of Examples 16, 20, and 21 to Comparative Examples 4 and 5, each in which the copolymer (A) containing the same monomers and the copolymer (B) containing the same monomers but each having a different Mw were used, show that these examples are superior to these comparative examples. The HTHS viscosity is very low and the low temperature viscosity is very low in these examples. In particular, a comparison of Example 6 to Comparative Example 3 and a comparison of Example 21 to Comparative Example 5, each in which the Mw ratio {(A)/(B)} is near 2, show that a Mw ratio {(A)/(B)} of 2 or more results in highly excellent performance even when the total amount of the copolymers (A) and (B) in the lubricating oil composition is small. Similarly, a comparison of Example 16 to Comparative Example 4, each in which the Mw ratio {(A)/(B)} is near 55, shows that a Mw ratio {(A)/(B)} of 55 or less results in highly excellent performance even when the total amount of the copolymers (A) and (B) in the lubricating oil composition is small. In particular, Examples 1 to 7, 10 to 11, 14 to 15, 17, 20, and 22, each in which the Mw ratio {(A)/(B)} of the copolymer (A) to the copolymer (B) is 5.0 to 33 and the weight ratio (A/B) of the copolymer (A) to the copolymer (B) is 12 to 38, were rated "very good" or "excellent" in all the evaluation results, showing an excellent balance of shear stability, HTHS viscosity, viscosity index, and low temperature viscosity.

Examples 23 to 44 and Comparative Examples 6 to 10: Evaluation of 0W-20 (SAE J300 Engine Oil Standard)

(1) Production of Viscosity Index Improver Composition

The viscosity index improver compositions (1) to (22) obtained in Examples 1 to 22 and the viscosity index improver compositions (1') to (5') obtained in Comparative Examples 1 to 5 were used.

(2) Production of Lubricating Oil Composition

A reaction vessel was charged with a base oil A (SP: 8.3 $(cal/cm^3)^{1/2}$, kinematic viscosity at 100° C.: 4.2 $mm^2/s$, viscosity index: 128) (90 parts) and a package additive (Infineum P5741) (10 parts). Then, the viscosity index improver compositions (1) to (22) and (1') to (5') were added to the respective mixtures to obtain lubricating oil compositions each having a HTHS viscosity at 150° C. of 2.60±0.05 ($mm^2/s$). Thus, lubricating oil compositions (V23) to (V44) and (W6) to (W10) containing the respective viscosity index improver compositions were obtained. The total amount (wt %) of the copolymers (A) and (B) in the lubricating oil composition is as described in Tables 5 and 6.

The HTHS viscosity (100° C.), viscosity index, shear stability, and low temperature viscosity (−40° C.) of the lubricating oil compositions (V23) to (V44) and (W6) to (W10) were measured by the following methods. Tables 5 and 6 show the results.

<Method of Measuring HTHS Viscosity of Lubricating Oil Composition>

The HTHS viscosity was measured at 100° C. by the method of ASTM D 4683. A lower HTHS viscosity means better HTHS viscosity at 100° C. In this evaluation, the HTHS viscosity reducing effect was evaluated as follows based on the HTHS viscosity at 100° C.: more than 4.70 mPa·s: poor; 4.70 mPa·s or less: good; 4.60 mPa·s or less: very good; and 4.50 mPa·s or less: excellent.

<Method of Calculating Viscosity Index of Lubricating Oil Composition>

The kinematic viscosity at 40° C. and 100° C. were measured by the method of JIS K 2283, and the viscosity index was calculated by the method of JIS K 2283. A greater viscosity index means a higher viscosity index improving effect. In this evaluation, the viscosity index improving effect was evaluated as follows based on the viscosity index: lower than 195: poor; 195 or higher: good; 230 or higher: very good; and 260 or higher: excellent.

<Methods of Measuring and Calculating Shear Stability of Lubricating Oil Composition>

Evaluation was performed according to JPI-5S-29-2006. A smaller value means a higher shear stability. In this evaluation, the shear stability was evaluated as follows: more than 18%: poor; 18% or less: good; 13% or less: very good; and 8% or less: excellent.

<Method of Measuring Low Temperature Viscosity of Lubricating Oil Composition>

The viscosity at −40° C. was measured by the method of JPI-5S-42-2004. A lower value means a lower viscosity at low temperatures and better low temperature viscosity. In this evaluation, the low temperature viscosity was evaluated as follows based on the viscosity at −40° C.: more than 37000 mPa·s: poor; 37000 mPa·s or less: good; 32000 mPa·s or less: very good; and 270100 mPa·s or less: excellent.

TABLE 5

| | Copolymer composition | Copolymer | Example 23 | 24 | 25 | 26 | 27 | 28 | 29 | 30 |
|---|---|---|---|---|---|---|---|---|---|---|
| Amount in viscosity index improver composition (parts by weight) | 1 | A1 | 20 | | | | | | | |
| | 2 | A2 | | 20 | | | | | | |
| | 3 | A3 | | | 20 | | | | | |
| | 4 | A4 | | | | 20 | | | | |
| | 5 | A5 | | | | | 20 | | | |
| | 6 | A6 | | | | | | 22 | | |
| | 7 | A7 | | | | | | | 22 | |
| | 8 | A8 | | | | | | | | 20 |
| | 9 | A9 | | | | | | | | |
| | 10 | A10 | | | | | | | | |
| | 11 | A11 | | | | | | | | |
| | 12 | A12 | | | | | | | | |
| | 13 | A13 | | | | | | | | |
| | 14 | A14 | | | | | | | | |
| | 15 | A15 | | | | | | | | |
| | 17 | A17 | | | | | | | | |
| | 18 | A18 | | | | | | | | |
| | 19 | A19 | | | | | | | | |
| | 20 | A20 | | | | | | | | |
| | 21 | B1 | 0.52 | | | 0.72 | | | | |
| | 22 | B2 | | 1.50 | | | 0.65 | 1.05 | 1.05 | |
| | 23 | B3 | | | 1.37 | | | | | 0.33 |
| | 24 | B4 | | | | | | | | |
| | 25 | B5 | | | | | | | | |
| | Base oil | | 79.48 | 78.50 | 78.63 | 79.28 | 79.35 | 76.95 | 76.95 | 79.67 |
| | Total | | 100 | 100 | 100 | 100 | 100 | 100 | 100 | 100 |
| Weight ratio of (A) to (B) in viscosity index improver composition (A/B) | | | 38 | 13 | 15 | 28 | 31 | 21 | 21 | 62 |
| Mw ratio of (A) to (B) (A/B) | | | 28 | 8.4 | 6.0 | 33 | 10 | 9.4 | 8.8 | 2.3 |
| Viscosity index improver composition | | | 1 | 2 | 3 | 4 | 5 | 6 | 7 | 8 |
| Lubricating oil composition | | | (V23) | (V24) | (V25) | (V26) | (V27) | (V28) | (V29) | (V30) |
| Total amount of copolymers (A) and (B) in lubricating oil composition (wt %) | | | 1.85 | 2.15 | 2.14 | 2.49 | 2.27 | 2.29 | 2.32 | 2.44 |
| Results | HTHS viscosity (100° C.) (mPa · s) | | 4.51 | 4.53 | 4.55 | 4.51 | 4.57 | 4.58 | 4.60 | 4.66 |
| | Viscosity index | | 265 | 238 | 240 | 255 | 254 | 252 | 249 | 209 |
| | Shear stability (%) | | 12 | 8 | 9 | 10 | 9 | 9 | 8 | 5 |
| | Low temperature viscosity (−40° C.) (mPa · s) | | 22,000 | 23,500 | 24,000 | 20,000 | 21,000 | 28,500 | 28,000 | 31,000 |
| Evaluation | HTHS viscosity (100° C.) (mPa · s) | | Very good | Very good | Very good | Very good | Very good | Very good | Very good | Good |
| | Viscosity index | | Excellent | Very good | Very good | Very good | Very good | Very good | Very good | Good |
| | Shear stability (%) | | Very good | Excellent | Very good | Very good | Very good | Very good | Excellent | Excellent |
| | Low temperature viscosity (−40° C.) (mPa · s) | | Excellent | Excellent | Excellent | Excellent | Excellent | Very good | Very good | Very good |

TABLE 5-continued

| | Copolymer composition | Copolymer | Example 31 | 32 | 33 | 34 | 35 | 36 | 37 |
|---|---|---|---|---|---|---|---|---|---|
| Amount in viscosity index improver composition (parts by weight) | 1 | A1 | | | | | | | |
| | 2 | A2 | | | | | | | |
| | 3 | A3 | | | | | | | |
| | 4 | A4 | | | | | | | |
| | 5 | A5 | | | | 20 | 20 | 20 | |
| | 6 | A6 | | | | | | | |
| | 7 | A7 | | | | | | | |
| | 8 | A8 | | | | | | | |
| | 9 | A9 | 20 | | | | | | |
| | 10 | A10 | | 20 | | | | | |
| | 11 | A11 | | | 20 | | | | |
| | 12 | A12 | | | | | | | 20 |
| | 13 | A13 | | | | | | | |
| | 14 | A14 | | | | | | | |
| | 15 | A15 | | | | | | | |
| | 17 | A17 | | | | | | | |
| | 18 | A18 | | | | | | | |
| | 19 | A19 | | | | | | | |
| | 20 | A20 | | | | | | | |
| | 21 | B1 | 1.63 | | | | | | |
| | 22 | B2 | | 0.81 | | 3.90 | 0.20 | 0.98 | 0.65 |
| | 23 | B3 | | | 1.56 | | | | |
| | 24 | B4 | | | | | | | |
| | 25 | B5 | | | | | | | |
| | Base oil | | 78.37 | 79.19 | 78.44 | 76.10 | 79.80 | 79.02 | 79.35 |
| | Total | | 100 | 100 | 100 | 100 | 100 | 100 | 100 |
| Weight ratio of (A) to (B) in viscosity index improver composition (A/B) | | | 12 | 25 | 13 | 5 | 100 | 21 | 31 |
| Mw ratio of (A) to (B) (A/B) | | | 55 | 19 | 5.5 | 10 | 10 | 10 | 10 |
| Viscosity index improver composition | | | 9 | 10 | 11 | 12 | 13 | 14 | 15 |
| Lubricating oil composition | | | (V31) | (V32) | (V33) | (V34) | (V35) | (V36) | (V37) |
| Total amount of copolymers (A) and (B) in lubricating oil composition (wt %) | | | 1.51 | 1.67 | 2.16 | 2.63 | 2.22 | 2.31 | 2.24 |
| Results | HTHS viscosity (100° C.) (mPa · s) | | 4.49 | 4.46 | 4.59 | 4.58 | 4.56 | 4.57 | 4.58 |
| | Viscosity index | | 305 | 299 | 280 | 226 | 255 | 254 | 255 |
| | Shear stability (%) | | 17 | 12 | 7 | 9 | 9 | 9 | 9 |
| | Low temperature viscosity (−40° C.) (mPa · s) | | 30,000 | 29,000 | 27,000 | 30,000 | 33,000 | 20,000 | 22,000 |
| Evaluation | HTHS viscosity (100° C.) (mPa · s) | | Excellent | Excellent | Very good | Very good | Very good | Very good | Very good |
| | Viscosity index | | Excellent | Excellent | Excellent | Good | Very good | Very good | Very good |
| | Shear stability (%) | | Good | Very good | Excellent | Very good | Very good | Very good | Very good |
| | Low temperature viscosity (−40° C.) (mPa · s) | | Very good | Very good | Excellent | Very good | Good | Excellent | Excellent |

| | Copolymer composition | Copolymer | Example 38 | 39 | 40 | 41 | 42 | 43 | 44 |
|---|---|---|---|---|---|---|---|---|---|
| Amount in viscosity index improver composition (parts by weight) | 1 | A1 | | | | | | | |
| | 2 | A2 | | | | | | | |
| | 3 | A3 | | | | | | | |
| | 4 | A4 | | | | | | | |
| | 5 | A5 | | 20 | | | | | |
| | 6 | A6 | | | | | | | |
| | 7 | A7 | | | | | | | |
| | 8 | A8 | | | | | | | |
| | 9 | A9 | | | | | | | |
| | 10 | A10 | | | | | | | |
| | 11 | A11 | | | | | | | |
| | 12 | A12 | | | | | | | |
| | 13 | A13 | 20 | | | | | | |
| | 14 | A14 | | | 20 | | | | |
| | 15 | A15 | | | | 20 | | | |
| | 17 | A17 | | | | | 20 | | |
| | 18 | A18 | | | | | | 20 | |
| | 19 | A19 | | | | | | | |
| | 20 | A20 | | | | | | | 20 |
| | 21 | B1 | | | | | | | |
| | 22 | B2 | | | | | | | 0.65 |
| | 23 | B3 | | | 0.33 | 0.33 | | | |

TABLE 5-continued

| | | | | | | | | | |
|---|---|---|---|---|---|---|---|---|---|
| | 24 | B4 | | 0.65 | | | | | |
| | 25 | B5 | 1.60 | | | | 1.60 | 1.60 | 1.60 |
| | Base oil | | 78.40 | 79.35 | 79.67 | 79.67 | 78.40 | 78.40 | 77.75 |
| | Total | | 100 | 100 | 100 | 100 | 100 | 100 | 100 |
| Weight ratio of (A) to (B) in viscosity index improver composition (A/B) | | | 13 | 31 | 61 | 61 | 13 | 13 | 31 |
| Mw ratio of (A) to (B) (A/B) | | | 40 | 5.0 | 9.0 | 15 | 10 | 3.0 | 10 |
| Viscosity index improver composition | | | 16 | 17 | 18 | 19 | 20 | 21 | 22 |
| Lubricating oil composition | | | (V38) | (V39) | (V40) | (V41) | (V42) | (V43) | (V44) |
| Total amount of copolymers (A) and (B) in lubricating oil composition (wt %) | | | 1.46 | 2.21 | 1.70 | 1.42 | 2.30 | 2.17 | 2.25 |
| Results | HTHS viscosity (100° C.) (mPa · s) | | 4.47 | 4.55 | 4.57 | 4.53 | 4.60 | 4.69 | 4.60 |
| | Viscosity index | | 307 | 253 | 274 | 314 | 238 | 197 | 252 |
| | Shear stability (%) | | 18 | 9 | 14 | 18 | 9 | 8 | 10 |
| | Low temperature viscosity (−40° C.) (mPa · s) | | 37,000 | 24,000 | 31,000 | 26,000 | 23,000 | 21,000 | 23,000 |
| Evaluation | HTHS viscosity (100° C.) (mPa · s) | | Excellent | Very good | Very good | Very good | Very good | Good | Very good |
| | Viscosity index | | Excellent | Very good | Excellent | Excellent | Very good | Good | Very good |
| | Shear stability (%) | | Good | Very good | Good | Good | Very good | Excellent | Very good |
| | Low temperature viscosity (−40° C.) (mPa · s) | | Good | Excellent | Very good | Excellent | Excellent | Excellent | Excellent |

TABLE 6

| | Copolymer | | Comparative Example | | | | |
|---|---|---|---|---|---|---|---|
| | composition | Copolymer | 6 | 7 | 8 | 9 | 10 |
| Amount in viscosity index improver composition (parts by weight) | 5 | A5 | 20 | 20 | | | |
| | 8 | A6 | | | 20 | | |
| | 13 | A13 | | | | 20 | |
| | 19 | A19 | | | | | 20 |
| | 21 | B1 | | | | 1.59 | |
| | 22 | B2 | 5.20 | 0.18 | | | |
| | 23 | B3 | | | | | |
| | 24 | B4 | | | 0.33 | | |
| | 25 | B5 | | | | | 1.60 |
| | Base oil | | 74.80 | 79.82 | 79.67 | 78.41 | 78.40 |
| | Total | | 100 | 100 | 100 | 100 | 100 |
| Weight ratio of (A) to (B) in viscosity index improver composition (A/B) | | | 4 | 110 | 61 | 13 | 13 |
| Mw ratio of (A) to (B) (A/B) | | | 10 | 10 | 1.8 | 60 | 1.7 |
| Viscosity index improver composition | | | 1' | 2' | 3' | 4' | 5' |
| Lubricating off composition | | | (W6) | (W7) | (W8) | (W9) | (W10) |
| Total amount of copolymers (A) and (B) in lubricating off composition (wt %) | | | 2.77 | 2.22 | 2.60 | 1.60 | 2.44 |
| Results | HTHS viscosity (100° C.) (mPa · s) | | 4.65 | 4.62 | 4.68 | 4.58 | 4.80 |
| | Viscosity index | | 205 | 239 | 207 | 295 | 180 |
| | Shear stability (%) | | 9 | 9 | 8 | 21 | 13 |
| | Low temperature viscosity (−40° C.) (mPa · s) | | 39,000 | 43,500 | 40,000 | 56,000 | 69,000 |
| Evaluation | HTHS viscosity (100° C.) (mPa · s) | | Good | Good | Good | Very good | Poor |
| | Viscosity index | | Good | Very good | Good | Excellent | Poor |
| | Shear stability (%) | | Very good | Very good | Excellent | Poor | Very good |
| | Low temperature viscosity (−40° C.) (mPa · s) | | Poor | Poor | Poor | Poor | Poor |

As shown in the results of Tables 5 and 6, the lubricating oil compositions containing the viscosity index improver compositions of the present invention in which the Mw ratio {(A)/(B)} of the copolymer (A) to the copolymer. (B) is 2 to 55 and the weight ratio (A/B) of the copolymer (A) to (B) is 5 to 100 are excellent without being rated "poor" in the evaluation results. The shear stability is excellent, the HTHS viscosity is low, the viscosity index is high, and the low temperature viscosity is low. In particular, comparisons of Examples 27 and 34 to 36 to Comparative Examples 6 and 7, each in which the same copolymer (A) and the same copolymer (B) were used at a different weight ratio (A/B), show that these examples in which the weight ratio (A/B) is 5 to 100 are excellent. The viscosity index is very high and the low temperature viscosity is very low. Comparisons of Examples 30, 40, and 41 to Comparative Example 8 and comparisons of Examples 38, 42, and 43 to Comparative Examples 9 and 10, each in which the copolymer (A) containing the same monomers and the copolymer (B) containing the same monomers but each having a different Mw were used, show that these examples are superior to these comparative examples. The HTHS viscosity is very low and the low temperature viscosity is very low in these examples. In particular, a comparison of Example to Comparative Example 8 and a comparison of Example 43 to Comparative Example 10, each in which the Mw ratio {(A)/(B)} is near 2, show that a Mw ratio {(A)/(B)} of 2 or more results in highly excellent performance even when the total amount of the copolymers (A) and (B) in the lubricating oil composition is small. Similarly, a comparison of Example 38 to Comparative Example 9, each in which the Mw ratio {(A)/(B)} is near 55, shows that a Mw ratio {(A)/(B)} of 55 or less results in highly excellent performance even when the total amount of the copolymers (A) and (B) in the lubricating oil composition is small. In particular, Examples 23 to 29, 32 to 33, 36 to 37, 39, 42, and 44, each in which the Mw ratio {(A)/(B)} of the copolymer (A) to the copolymer (B) is 5.0 to 33 and the weight ratio (A/B) of the copolymer (A) to the copolymer (B) is 12 to 38, were rated "very good" or "excellent" in all the evaluation results, showing an excellent balance of shear stability, HTHS viscosity, viscosity index, and low temperature viscosity.

INDUSTRIAL APPLICABILITY

The lubricating oil compositions containing the viscosity index improver compositions of the present invention are suitable as gear oils (e.g., differential oil and industrial gear oil), MTF, transmission fluids (e.g., ATF, DCTF, and belt-CVTF), traction fluids (e.g., toroidal-CVTF), shock absorber fluids, power steering fluids, hydraulic oils (e.g., construction machinery hydraulic oil and industrial hydraulic oil), and the like.

The invention claimed is:

1. A viscosity index improver composition (C), comprising:

a copolymer (A) comprising a polyolefin-based monomer (a) represented by the following formula (1) as a constituent monomer;

a copolymer (B) comprising a (meth)acrylic acid alkyl ester (c) having a C12-C15 straight-chain or branched alkyl group and a (meth)acrylic acid alkyl ester (d) having a C16-C20 straight-chain or branched alkyl group as constituent monomers; and a base oil, wherein a weight average molecular weight ratio {(A)/(B)} of the copolymer (A) to the copolymer (B) is 2 to 55, and a weight ratio (AB) of the copolymer (A) to the copolymer (B) constituting the viscosity index improver composition (C) is 12 to 50:

(1)

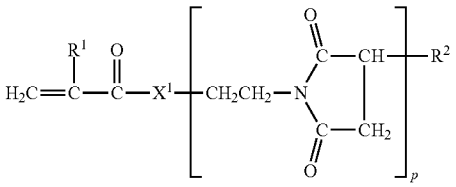

wherein $R^1$ is a hydrogen atom or a methyl group; —$X^1$— is a group represented by —O—, —$O(AO)_m$-, or —NH—, A is a C2-C4 alkylene group, m is an integer of 1 to 10, and each A may be the same or different when m is 2 or greater; $R^2$ is a residue after removal of one hydrogen atom from a hydrocarbon polymer comprising at least one of an isobutylene group or a 1,2-butylene group as a structural unit; and p represents a number of 0 or 1.

2. The viscosity index improver composition according to claim 1, wherein the copolymer (A) is a copolymer further comprising a monomer (b) represented by the following formula (2) as a constituent monomer:

(2)

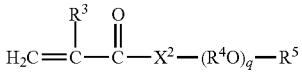

wherein $R^3$ is a hydrogen atom or a methyl group; —$X^2$— is a group represented by —O— or —NH—; $R^4$ is a C2-C4 alkylene group; $R^5$ is a C1-C8 alkyl group; and q is an integer of 1 to 20, and each $R^4$ may be the same or different when q is 2 or greater.

3. The viscosity index improver composition according to claim 1, wherein the hydrocarbon polymer comprising at least one of an isobutylene group or a 1,2-butylene group as a structural unit is a polymer in which the isobutylene group and the 1,2-butylene group sum up to 30 mol % or more based on the total number of moles of the structural units of the hydrocarbon polymer.

4. The viscosity index improver composition according to claim 2, wherein the copolymer (A) is a copolymer comprising, as constituent monomers, the monomer (a) in an amount of 1 to 50 wt % and the monomer (b) in an amount of 1 to 80 wt % with the sum of the monomer (a) and the monomer (b) being 10 wt % or more, based on the weight of the copolymer (A).

5. The viscosity index improver composition according to claim 1, wherein the copolymer (B) is a copolymer comprising the monomer (a) as a constituent monomer in an amount of less than 1 wt % based on the weight of the copolymer (B).

6. The viscosity index improver composition according to claim 1, wherein the copolymer (A) is a copolymer further comprising a (meth)acrylic acid alkyl ester (e) having a C1-C4 alkyl group as a constituent monomer.

7. The viscosity index improver composition according to claim 6, wherein the copolymer (A) is a copolymer comprising, as constituent monomers, the monomer (a) in an amount of 5 to 40 wt %, the monomer (b) in an amount of 5 to 60 wt %, and the (meth)acrylic acid alkyl ester (e) in an amount of 1 to 90 wt % based on the weight of the copolymer (A).

8. The viscosity index improver composition according to claim 1, wherein the copolymer (A) has a weight average molecular weight of 150,000 to 1,200,000.

9. The viscosity index improver composition according to claim 1, wherein the copolymer (B) is a copolymer comprising, as constituent monomers, the (meth)acrylic acid alkyl ester (c) in an amount of 50 to 98 wt % and the (meth)acrylic acid alkyl ester (d) in an amount of 2 to 50 wt % based on the weight of the copolymer (B).

10. The viscosity index improver composition according to claim 1, wherein the copolymer (B) has a weight average molecular weight of 20,000 to 100,000.

11. The viscosity index improver composition according to claim 1, wherein the base oil has a kinematic viscosity at 100° C. of 1 to 15 $mm^2/s$ and a viscosity index of 100 or higher.

12. A lubricating oil composition, comprising:

the viscosity index improver composition according to claim 1; and at least one additive selected from the group consisting of a detergent, a dispersant, an antioxidant, an oiliness improver, a pour point depressant, a friction and wear modifier, an extreme pressure agent, a defoamer, a demulsifier, a metal deactivator, and a corrosion inhibitor.

13. The viscosity index improver composition according to claim 1, wherein the weight average molecular weight ratio {(A)/(B)} of the copolymer (A) to the copolymer (B) is 5 to 35.

* * * * *